US009957698B2

(12) United States Patent
Pitsch et al.

(10) Patent No.: US 9,957,698 B2
(45) Date of Patent: May 1, 2018

(54) HYBRID FAUCET ASSEMBLY AND WATER WAY FOR SAME

(71) Applicant: AS IP Holdco, LLC, Piscataway, NJ (US)

(72) Inventors: Walter Pitsch, Washington, NJ (US); Marin Marinov, East Brunswick, NJ (US); Xiao Jing Ye, Guangzhou (CN)

(73) Assignee: AS IP Holdco, LLC, Piscataway, NJ (US)

( * ) Notice: Subject to any disclaimer, the term of this patent is extended or adjusted under 35 U.S.C. 154(b) by 585 days.

(21) Appl. No.: 13/847,469

(22) Filed: Mar. 19, 2013

(65) Prior Publication Data

US 2013/0248005 A1 Sep. 26, 2013

Related U.S. Application Data

(60) Provisional application No. 61/614,465, filed on Mar. 22, 2012.

(51) Int. Cl.
*E03C 1/04* (2006.01)

(52) U.S. Cl.
CPC ..... *E03C 1/04* (2013.01); *E03C 1/0404* (2013.01); *E03C 1/0412* (2013.01); *Y10T 137/0491* (2015.04); *Y10T 137/6014* (2015.04); *Y10T 137/87579* (2015.04)

(58) Field of Classification Search
CPC ..... E03C 1/04; E03C 1/0404; E03C 1/0412; Y10T 137/87579; Y10T 137/6014; Y10T 137/0491
USPC ..... 137/603, 801, 606
See application file for complete search history.

(56) References Cited

U.S. PATENT DOCUMENTS

| | | | |
|---|---|---|---|
| 4,484,600 | A | 11/1984 | Peterson |
| 5,123,445 | A | 6/1992 | Chung-Shan |
| 5,494,259 | A | 2/1996 | Peterson |
| 5,669,407 | A | 9/1997 | Bailey |
| 5,746,244 | A | 5/1998 | Woolley, Sr. |

(Continued)

FOREIGN PATENT DOCUMENTS

| | | | |
|---|---|---|---|
| CN | 201470540 | U | 5/2010 |
| CN | 201475416 | U | 5/2010 |

(Continued)

*Primary Examiner* — Jessica Cahill
*Assistant Examiner* — Frederick D Soski
(74) *Attorney, Agent, or Firm* — Morrison & Foerster LLP

(57) ABSTRACT

A faucet assembly is disclosed which is of a modular type for use in varying faucet designs and incorporating polymeric or partially polymeric parts in the internal water way assembly therein. The faucet assembly includes a cover plate and an internal water way assembly as well as at least one faucet handle. The internal water way assembly includes a valve assembly having a shank and a valve water way portion positioned on an upper portion of the shank. The valve water way portion defines a valve seat therein, and has a transversely extending outlet passageway. A valve cartridge for controlling flow through the assembly is seated in the valve seat, and, a bridge, which may be a single component or multi-part bridge has a passageway therethrough to receive water from the valve water way portion and a spout receiving portion. A spout tube is configured to be positioned in or on the spout receiving portion of the bridge. The internal water way assembly is attached to the cover plate.

42 Claims, 28 Drawing Sheets

(56) References Cited

U.S. PATENT DOCUMENTS

| | | | | |
|---|---|---|---|---|
| 5,865,473 | A * | 2/1999 | Semchuck et al. | 285/55 |
| 6,023,796 | A * | 2/2000 | Pitsch | 4/678 |
| 6,161,230 | A * | 12/2000 | Pitsch | 4/678 |
| 6,170,098 | B1 | 1/2001 | Pitsch | |
| 6,189,569 | B1 * | 2/2001 | Calhoun | 137/801 |
| 6,202,686 | B1 | 3/2001 | Pitsch | |
| 6,381,776 | B1 | 5/2002 | Wang | |
| 6,405,749 | B1 | 6/2002 | Bloom | |
| D466,980 | S * | 12/2002 | Pitsch et al. | D23/241 |
| D532,871 | S | 11/2006 | Berberet | |
| D533,637 | S | 12/2006 | Berberet | |
| 7,269,864 | B2 | 9/2007 | Brown | |
| 7,406,980 | B2 | 8/2008 | Pinette | |
| D589,595 | S | 3/2009 | Eilmus | |
| 7,766,043 | B2 | 8/2010 | Thomas | |
| 7,793,677 | B2 | 9/2010 | Pinette | |
| 7,927,534 | B1 | 4/2011 | Seman, Sr. | |
| 7,934,520 | B2 | 5/2011 | Esche | |
| 7,979,929 | B2 * | 7/2011 | Vogel et al. | 4/695 |
| 8,011,384 | B2 | 9/2011 | Izzy | |
| 8,046,850 | B2 | 11/2011 | Chang | |
| 8,695,625 | B2 | 4/2014 | Marty | |
| 2005/0236047 | A1 * | 10/2005 | Thomas et al. | 137/359 |
| 2007/0044852 | A1 * | 3/2007 | Pinette | E03C 1/0403 137/606 |
| 2007/0272312 | A1 * | 11/2007 | Chang | 137/606 |
| 2008/0178954 | A1 | 7/2008 | Pinette | |
| 2008/0196776 | A1 * | 8/2008 | Ko | 137/603 |
| 2008/0264502 | A1 * | 10/2008 | Lin | 137/603 |
| 2009/0025809 | A1 * | 1/2009 | Oh | 137/801 |
| 2009/0078325 | A1 * | 3/2009 | Lin | 137/801 |
| 2009/0250127 | A1 | 10/2009 | Izzy | |
| 2010/0043898 | A1 * | 2/2010 | Eckhaus | 137/625 |
| 2010/0155505 | A1 * | 6/2010 | Lopp et al. | 239/428.5 |
| 2010/0212086 | A1 * | 8/2010 | Chang | 4/676 |
| 2010/0272503 | A1 * | 10/2010 | Pitsch et al. | 403/21 |
| 2011/0079307 | A1 * | 4/2011 | Marty et al. | 137/801 |
| 2011/0259456 | A1 | 10/2011 | Pinette | |
| 2012/0227843 | A1 * | 9/2012 | Thomas et al. | 137/603 |

FOREIGN PATENT DOCUMENTS

| | | | |
|---|---|---|---|
| CN | 201475461 | U | 5/2010 |
| CN | 201475481 | U | 5/2010 |
| CN | 201475558 | U | 5/2010 |
| CN | 201475559 | U | 5/2010 |
| CN | 102076599 | A | 5/2011 |
| JP | 1998259625 | A | 9/1998 |
| WO | WO 1995026857 | A1 | 10/1995 |
| WO | WO 2009126887 | A1 | 10/2009 |
| WO | WO 2009158498 | A1 | 12/2009 |

* cited by examiner

HYBRID FAUCET ASSEMBLY AND WATER WAY FOR SAME

CROSS-REFERENCE TO RELATED APPLICATION

This application claims the benefit under 35 U.S.C. § 119(e) to U.S. Provisional Patent Application No. 61/614,465, filed Mar. 22, 2012, entitled, "Hybrid Faucet Assembly And Water Way For Same," the entire disclosure of which is incorporated herein by reference.

BACKGROUND OF THE INVENTION

Field of the Invention

The invention relates to the field of faucet assemblies and internal faucet water way assemblies and components thereof. More particularly, the invention relates to such faucet assemblies and internal faucet water way assemblies, wherein a portion of the internal waterway assembly of the faucet is formed of a polymeric or composite material.

Description of Related Art

Traditionally, faucet assemblies have been formed with copper and/or brass internal water way structures. The structures fit under a metallic outer cover plate structure which may have a separate faucet spout or outlet portion having various internal faucet water way configurations for delivery of water from within the faucet assembly base to the outlet through an aerator or similar outlet in the spout. Such internal structures are supported by and/or are built within an internal metallic support base which may also have a separate putty plate. Such faucet assemblies are mounted to a mounting surface using mounting methods known in the art. Over time, cost and expense of using metallic parts has given rise to attempts to create internal water way structures or other parts within a faucet assembly, such as within a valve cartridge of a faucet assembly or within the exit portion of the faucet assembly of polymeric materials.

Also in an attempt to create new design possibilities and provide a different option installation, some manufacturers have developed spread faucet assemblies wherein individual portions of the faucet (valve assembly or spout) are not within a standard faucet cover and base, but are each independently mounted on a mounting surface and connected using various mechanisms beneath the mounting surface. Such structures tend to be more complex to install than a standard faucet structure with the internal water way structure located under a common cover within a housing.

In designing such new faucet structures that may included polymeric molded pieces, molding of the internal pieces while maintaining a sanitary and securely connected internal water way structure has given rise to various configurations. When the exterior configuration or shape of the faucet housing changes, the internal water way structure and the interior of the faucet assembly outlet faucet portion must be reconfigured to work within various outer structures.

U.S. Pat. Nos. 7,793,677 and 7,406,980 show what is identified as a connecting water way structure which may include plastic which extends between a valve body section and a faucet spout portion. A bridge faucet with an elevated bridge extending above the mounting surface of the sink is taught as well in U.S. Pat. No. 8,011,384. The patent describes a way to connect a faucet spout to the elevated bridge using a coupler having a rod that can be actuated by a tool from its upper end.

U.S. Publication No. 2011/0259456 A1 discloses a polymeric bridge for a lavatory faucet. The faucet has a coupler that is molded plastic and includes two valve supports molded within the coupler and two valve interfaces extending upwardly to receive a gasket. An outlet tube sits within the spout and the tube connects into the bridge. Hot and cold water inlet tubes are over-molded into the device so that the water can flow through the over-molded inlet into the connector and into the coupler to a central outlet. A method for molding a water way is also included in which tubes and mandrels are used to form valve interfaces.

Chinese Patent Application Publication No. 201475416UA teaches a core body structure for a faucet bridge that has a molded three-way bridge insert and then a secondary molded water channel body molded over the bridge insert. The body and insert have a through hole and a water outlet for a faucet tube. The end surfaces of the three-way bridge insert are each provided with a curved surface structure to mate with a vertical shank or pipe. The outer surface of the three-way bridge insert after secondary molding is completely embedded in the molded water channel body. This faucet helps save cost of metallic parts but must be formed by pre-assembly and two-part insert molding for different size faucet designs. The placement of the curved surfaces of the bridge insert against the shank or pipes holds the bridge steady but allows for the faucet tube attachment in only a single molded location once secondary molding has the entire body structure fixed.

Thus, while there are prior art structures incorporating polymeric materials in one or more features of a water way assembly, or forming a over-molded valve structures connected to inlet and outlet tubes for water supply, there is still a need in the art for an improved, flexible design using polymeric materials or formed as a hybrid structure incorporating both metallic and polymeric materials, that minimizes the use of copper and/or brass materials in the faucet assembly except if desired, for example in a high pressure water way area, is easy to assemble and install and keeps manufacturing costs low by eliminating some of the complexity or large number of internal parts in an internal water way assembly of a faucet assembly. Further, a need in the art exists for such faucet water way assemblies, wherein such assemblies have simplified manufacturing options and versatility, while maximizing the ability to provide a wide variety of faucet design configurations using only a few basic and standard component parts.

BRIEF SUMMARY OF THE INVENTION

The invention includes in one embodiment a faucet assembly, comprising (a) a cover plate having an interior surface and an exterior surface; and (b) an internal water way assembly, comprising (i) a valve assembly having a shank defining a longitudinally extending interior passageway therein, and a valve water way portion positioned on an upper portion of the shank and configured to define a valve seat therein, wherein the valve water way portion has a transversely extending outlet passageway therein, and the valve seat is configured to receive fluid from a fluid source, (ii) a valve cartridge for controlling flow through the internal water way assembly having an inlet for receiving water entering the valve seat and an outlet in communication with the outlet passageway of the valve water way portion; (iii) a bridge having a passageway therethrough in fluid communication with and to receive water from the outlet passageway of the valve water way portion of the valve assembly and the bridge having a spout receiving portion having a passageway therethrough; and (iv) a spout tube having an inlet end configured to be positioned in the spout receiving portion of the bridge, the spout tube open at the inlet end and in fluid communication with the passageway in the bridge and having a second outlet end for delivering water out of the faucet assembly when in use; and (c) at least one faucet handle positioned outside an interior space defined by the interior surface of the cover plate and capable of operably moving the valve cartridge for controlling the flow through the internal water way assembly, wherein the internal water way assembly is attached to the cover plate, the bridge is a separate piece so as to be rotatably positioned with respect to the valve assembly prior to attachment of the bridge to the valve water way portion of the valve assembly and at least one component in the internal water way assembly comprises a polymeric material.

In a preferred embodiment of the faucet assembly herein, the internal water way assembly is releasably attached to the cover plate. The valve assembly may have at least one outwardly extending tap with a hole therein for receiving a fastener and the interior surface of the cover plate has at least one receiving bore for receiving the fastener such that the internal water way assembly is releasably attached to the interior surface of the cover plate by the fastener. The fastener may be a self-tapping screw and the at least one receiving bore receives the self-tapping screw. The valve assembly may have two or more of the outwardly extending taps, each with the hole therein and the interior surface of the cover plate also have two or more mating receiving bores.

The faucet assemblies herein may have two valve assemblies, each located on an opposite end of the bridge. In such embodiment, each of the valve assemblies may have at least one outwardly extending tap with a hole therein for receiving a fastener and the interior surface of the cover plate also preferably has at least two receiving bores for receiving a fastener such that the internal water way assembly is releasably attached to the interior surface of the cover plate by at least two fasteners. The fasteners may be self-tapping screws and the receiving bores receive the self-tapping screws. Two or more of such taps and receiving bores may be provided for each valve assembly.

In one embodiment herein, the shank, the valve water way portion, the bridge and the spout tube each comprise a polymeric material. Further, the valve water way portion and the shank may be unitarily formed.

In another embodiment, the shank may comprise a metallic material and the valve water way portion(s), the bridge and the spout tube all comprise a polymeric material. The shank, the valve water way portion(s) and the bridge may alternatively all comprise a metallic material with the spout tube comprising a polymeric material.

Further, the shank may comprises a metallic material and a polymeric material and the valve water way portion(s), the bridge and the spout tube all comprise a polymeric material.

In a further embodiment, the valve water way portion has a bridge receiving portion and the transversely extending outlet passageway of the valve water way portion passes at least partially through the bridge receiving portion, the bridge receiving portion is open at one end, the bridge has an open inlet end in communication with the passageway through the bridge and the transversely extending outlet passageway of the valve water way portion, and the inlet end of the bridge being configured to engage the bridge receiving portion of the valve water way portion, such that the valve assembly is releasably attachable to the bridge and such that the shank and the valve water way portion form a separable assembly. In such an embodiment, the bridge receiving portion of the valve water way portion of the valve assembly may sealingly engage the inlet end of the bridge, and the bridge can be rotatably positioned by a user prior to assembly so that the spout receiving portion is axially located to enable the spout tube to have a configuration that fits within an interior space defined by the interior surface of the cover plate.

The spout tube may also be made to be flexible so as to be manipulated to fit within the interior space and/or may be pre-formed to have a shape to fit within the interior space.

In a further embodiment, there may be a second valve assembly positioned on an opposite end of the bridge from the valve assembly, wherein the second valve assembly has a second valve water way portion having a bridge receiving portion and a second transversely extending outlet passageway extending partially therethrough, and wherein the bridge has a second inlet opening on an opposite end from the inlet opening, the second inlet opening also being in communication with the passageway through the bridge and with the second transversely extending outlet passageway of the second valve water way portion of the second valve assembly, wherein the second inlet end of the bridge is configured to engage the second bridge receiving portion of the second valve water way portion, such that the second valve assembly is releasably attachable to the bridge and such that a second shank of the second valve assembly and the second valve water way portion form a separable assembly.

In another embodiment of the faucet assembly, the valve water way portion has a bridge receiving portion and the transversely extending outlet passageway of the valve water way portion passes at least partially through the bridge receiving portion. In that embodiment, the bridge receiving portion is open at one end. The bridge has an open inlet end in communication with the passageway through the bridge and the transversely extending outlet passageway of the valve water way portion. The inlet end of the bridge is configured to engage the bridge receiving portion of the valve water way portion. The shank and the valve water way portion are a separable assembly from the bridge for rotatable positioning of the bridge prior to assembly, and upon assembly, the valve assembly is permanently attached to the bridge.

The cover plate of the faucet assembly may be formed so as to be a multi-part cover plate having a top cover plate configured to cover the internal water way assembly and to be positioned on an upper surface of the spout tube, and a bottom cover plate configured to cover a bottom surface portion of the spout tube, wherein the top and the bottom cover plates are configured to be locked together.

The cover plate of the faucet assembly may also have a female receiving bore and the bottom cover plate be formed with a male connecting pin for snap-fitting the top and the bottom cover plates together.

The cover plate may also be a multi-part cover plate and have a top spout plate configured to over the spout tube and a bottom plate configured to fit over the valve assembly and the bridge.

The faucet assembly may further comprise a putty plate for installation purposes and/or may further comprise a nut(s) to fit on the shank(s) to tighten the faucet assembly against a mounting surface.

The valve cartridge also preferably extends upwardly through a valve cartridge opening in the cover plate into an interior space within the faucet handle.

In another embodiment, the spout receiving portion of the bridge may include an outwardly extending flange having a receiving hole(s) therein for receiving a fastener(s), and the cover plate may further comprise a receiving bore(s) such that the fastener(s) may be used to attach the spout receiving portion to the cover plate.

The bridge in the faucet assembly may be a single piece or a multi-part bridge. A multi-part bridge may include a valve water way section having an inlet in communication with the transversely extending outlet passageway of the valve water way portion of the valve assembly, and an outlet; and a spout receiving section comprising the spout receiving portion of the bridge and an inlet. The bridge passageway in such configuration extends through the valve water way section and the spout receiving section of the bridge when the valve water way section and the spout receiving section are assembled. The outlet of the valve water way section of the bridge may be configured to engage the inlet of the spout receiving section of the bridge. If the faucet includes a second valve assembly as in a two handled faucet, a multi-part bridge would then preferably also include a second valve water way section having an inlet in communication with a transversely extending outlet passageway of a valve water way portion of the second valve assembly, and an outlet. The spout receiving section further includes a second inlet, and the bridge passageway in such configuration would further extend through the second valve water way section when the valve water way section, the spout receiving section and the second valve water way section are assembled. The outlet of the second valve water way section may be configured to engage the second inlet of the spout receiving section.

The invention also includes a further embodiment of a faucet assembly herein, that comprises (a) a cover plate having an interior surface and an exterior surface; and (b) an internal water way assembly, comprising (i) a first and a second valve assembly, each of the first and the second valve assembly having a shank defining a longitudinally extending interior passageway therein, and a valve water way portion positioned on an upper portion of the shank and configured to define a valve seat therein, wherein the valve water way portion has bridge receiving portion having a transversely extending outlet passageway therein, and the valve seat is configured to receive fluid from a fluid source, (ii) a first valve cartridge and second valve cartridge, each for controlling flow through the internal water way assembly and each having an inlet for receiving water entering the respective valve seat of the first and the second valve assemblies and an outlet in communication with the respective outlet passageway of the bridge receiving portion of the valve water way portion of the first and the second valve assemblies; (iii) a bridge having a passageway therethrough and a first and a second open inlet end, the first open inlet end configured to fit within the bridge receiving portion of the valve water way portion of the first valve assembly so as to receive water from the outlet passageway of the bridge receiving portion of the valve water way portion of the first valve assembly, wherein the bridge passageway is in fluid communication with the outlet passageway of the bridge receiving portion of the valve water way portion, the second open inlet end of the bridge configured to fit within the bridge receiving portion of the valve water way portion of the second valve assembly so as to receive water from the outlet passageway of the bridge receiving portion of the valve water way portion of the second valve assembly, wherein the bridge passageway is also in fluid communication with the outlet passageway of the bridge receiving portion of the second valve assembly, and the bridge having a spout receiving portion having a passageway therethrough; and (iv) a spout tube having an inlet end configured to be positioned in the spout receiving portion of the bridge, the spout tube open at the inlet end and in fluid communication with the passageway in the bridge and having a second outlet end for delivering water out of the faucet assembly when in use; and (c) a first and a second valve handle, each being capable of operably moving the first and the second valve cartridges respectively for controlling the flow of water through the internal water way assembly, wherein the internal water way assembly is attached to the cover plate, the bridge is a separate piece so as to be rotatably positioned with respect to the valve assemblies prior to attachment of the bridge to the valve water way portions of the valve assemblies and wherein at least one component in the internal water way assembly comprises a polymeric material.

In this embodiment, the internal water way assembly may also be made configured so as to be releasably attached to the cover as noted above. Each of the shanks, each of the valve water way portions, the bridge and the spout tube may comprise a polymeric material. The first valve water way portion and the first shank may be unitarily formed as may be the second valve water way portion and the second shank. Alternatively, each of the shanks may comprise a metallic material and the each of the valve water way portions, the bridge and the spout tube may comprise a polymeric material. In another embodiment each of the shanks, each of the valve water way portions and the bridge may comprise a metallic material and the spout tube comprises a polymeric material. In yet another embodiment, each of the shanks may comprise a metallic material and a polymeric material and the valve water way portions, the bridge and the spout tube all comprise a polymeric material.

The bridge may be a multi-part bridge comprising a first valve water way section having an inlet in communication with the transversely extending outlet passageway of the first valve water way portion of the first valve assembly, and an outlet; a second valve water way section having an inlet in communication with the transversely extending outlet passageway of the second valve water way portion of the second valve assembly, and an outlet; and a spout receiving section comprising the spout receiving portion of the bridge, and having a first inlet and a second inlet. The bridge passageway would thus extend through the first valve water way section, the second valve water way section and the spout receiving section of the bridge when the first valve water way section, the second valve water way section and spout receiving section are assembled, the outlet of the first valve water way section is configured to engage the first inlet of the spout receiving section and the outlet of the second valve water way section is configured to engage the second inlet of the spout receiving section.

The spout receiving section of the bridge may comprise at least one tap for receiving a fastener and the cover plate comprise a receiving bore for receiving the fastener so as to connect the spout receiving section of the bridge to the cover plate. The fastener may be a self-tapping screw.

In a further embodiment, the invention includes a valve assembly for use in an internal water way assembly comprising a shank defining a longitudinally extending interior passageway therein, a valve water way portion positioned on an upper portion of the shank and configured to define a valve seat therein, wherein the valve water way portion has a transversely extending outlet passageway therein configured to mate with a separate bridge of an internal water way assembly, the valve seat configured to receive fluid from a fluid source and to seat a valve cartridge therein, the valve assembly being configured so that when attached to a bridge and spout tube forms an internal water way for a faucet.

The valve assembly of the invention may comprise a valve cartridge for controlling flow through the internal water way assembly having an inlet for receiving water entering the valve seat and an outlet in communication with the outlet passageway of the valve water way portion. The valve water way portion may include at least one tap having a hole for receiving a fastener, such that the valve assembly when assembled as a component in an internal water way is able to attach the internal water way to a faucet cover plate.

The invention further includes a method of assembling a faucet having an internal water way, comprising: (a) providing a cover plate having an interior surface defining an interior space; (b) assembling an internal water way having at least one component comprising a polymeric material by (i) forming a valve assembly comprising a shank defining a longitudinally extending interior passageway therein, and a valve water way portion positioned on an upper portion of the shank and configured to define a valve seat therein, the valve water way portion having a transversely extending outlet passageway therein, and the valve seat being configured to receive fluid from a fluid source, (ii) positioning a valve cartridge in the valve seat, the valve cartridge for controlling flow and having an inlet for receiving water entering the valve seat and an outlet in communication with the outlet passageway of the valve water way portion; (iii) providing a bridge having a passageway therethrough and a spout receiving portion having a passageway therethrough; (iv) rotatably positioning the bridge such that the spout receiving portion is aligned to receive a spout tube and the spout tube, bridge and valve assembly will fit within the interior space of the cover plate upon assembly; (v) attaching the bridge to the valve water way portion so that the passageway within the bridge is in fluid communication with and able to receive water from the outlet passageway of the valve water way portion of the valve assembly; and (vi) attaching an inlet end of a spout tube to the spout receiving portion of the bridge to form an assembled internal water way, wherein the spout tube is open at the inlet end so as to be in fluid communication with the passageway in the bridge upon attachment and the spout tube has a second outlet end for delivering water out of the faucet assembly when in use; (c) positioning the cover plate over the assembled internal water way and attaching the interior surface of the cover plate to the assembled internal water way; and (d) positioning a faucet handle on the valve cartridge so that the handle is capable of operably moving the valve cartridge for controlling the flow through the assembled internal water way.

In the method, step (b)(i) may further comprise forming a second valve assembly comprising a second shank defining a longitudinally extending interior passageway therein, and a second valve water way portion positioned on an upper portion of the second shank and configured to define a second valve seat therein, the second valve water way portion having a transversely extending outlet passageway therein, and the second valve seat being configured to receive fluid from a fluid source; step (b)(ii) may further comprise positioning a second valve cartridge in the second valve seat, the second valve cartridge for controlling flow and having an inlet for receiving water entering the second valve seat and an outlet in communication with the outlet passageway of the second valve water way portion; step (b)(v) may further comprise attaching the bridge to the second valve water way portion so that the passageway within the bridge is in fluid communication with and able to receive water from the outlet passageway of the second valve water way portion of the valve assembly; and step (d) may further comprise positioning a second faucet handle on the second valve cartridge so that the second handle is capable of operably moving the second valve cartridge for controlling the flow through the assembled internal water way.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
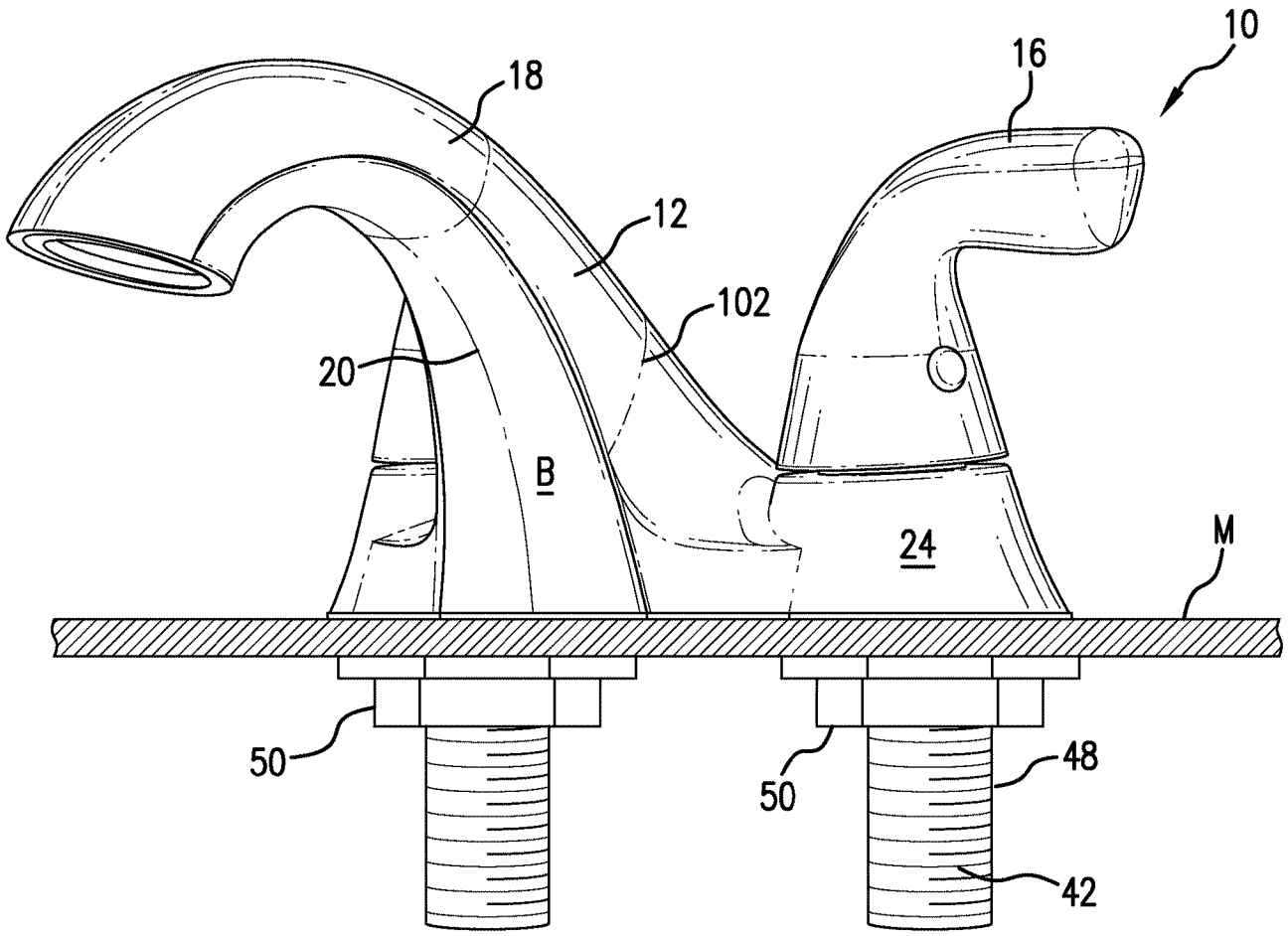
FIG. 1 is a perspective view of a faucet assembly according to an embodiment herein.
Figure 1A:
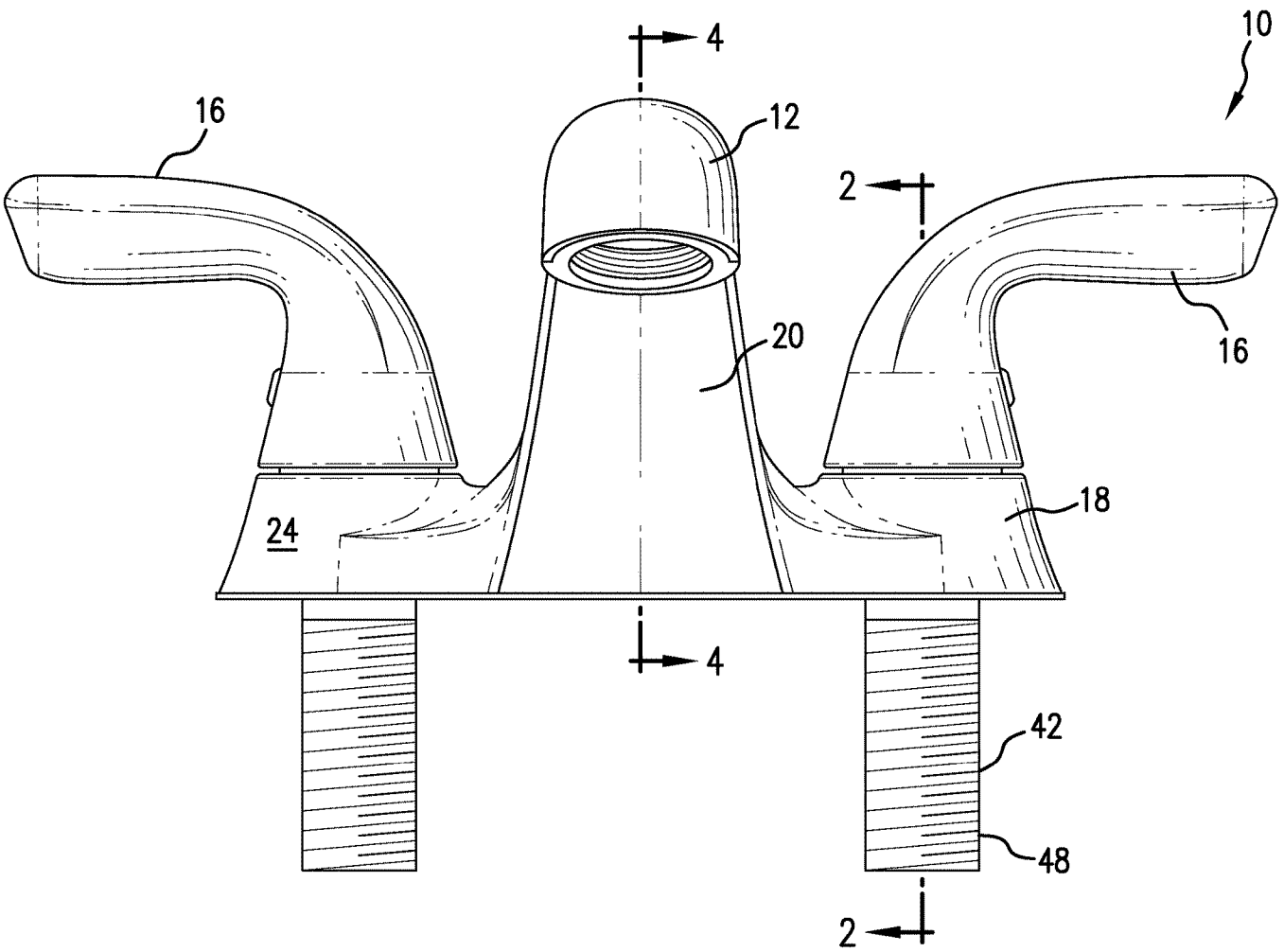
FIG. 1A is a front plan view of the faucet assembly of FIG. 1.
Figure 2:
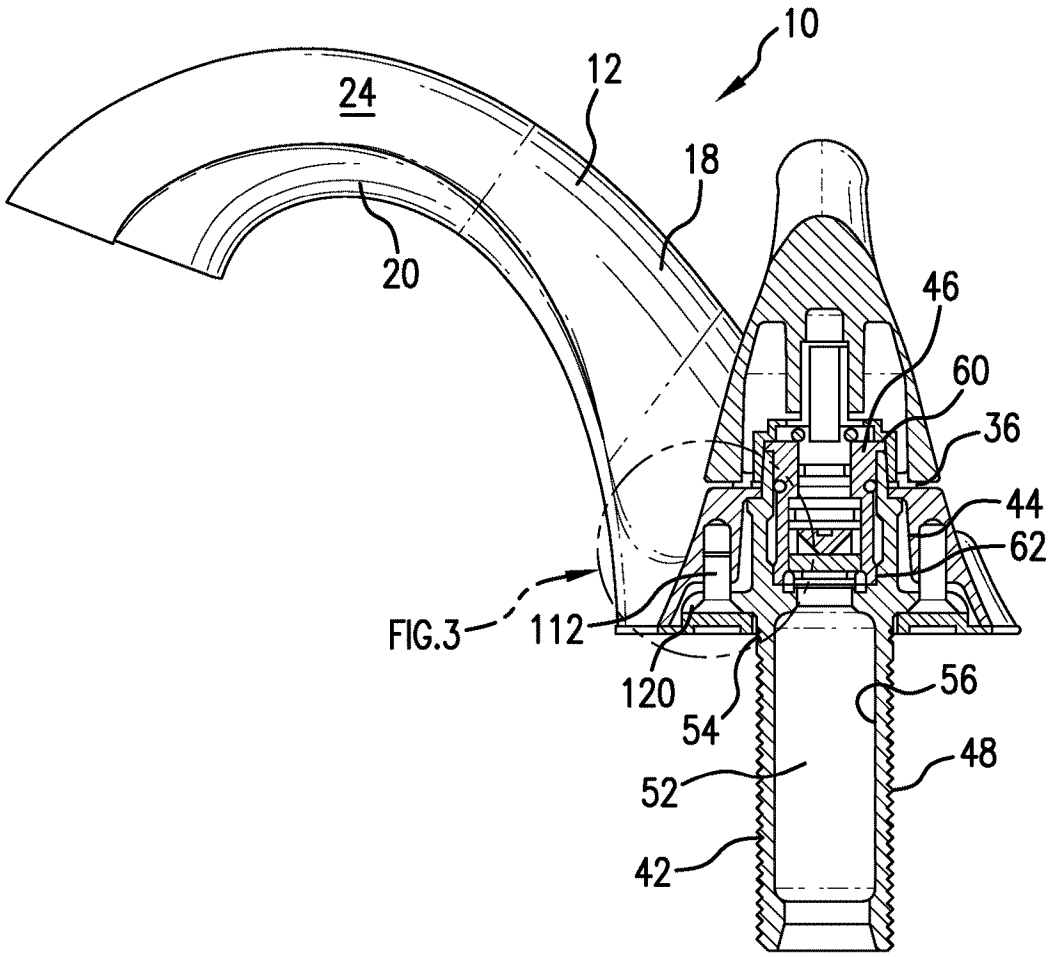
FIG. 2 is a right-side, cross-sectional view of the faucet assembly of FIG. 1A taken along line 2-2 of FIG. 1A.

The faucet assemblies herein provide unique options for economical and versatile product design. The faucet assemblies include internal water way assemblies including a valve assembly and bridge that work together in embodiments discussed herein to provide such advantages. Each valve assembly and/or the bridge preferably has one or more extending taps or connectors that enable attachment of the internal water way assembly via the valve assembly(ies) and/or the bridge directly to the cover plate of the faucet assembly. Such direct connection eliminates the need for a support plate which is a standard feature of most faucet assemblies.

In further embodiments, the valve assemblies are preferably formed independently of the bridge structure. The bridge can then be positioned with respect to the valve assembly(ies) prior to attaching the valve assembly(ies) to the bridge by rotating the bridge so that the opening that receives the spout tube when the spout tube is attached can lie at a variety of angles. The bridge may also be further angled frontwards or backwards along the horizontal x-y plane of the faucet and/or upwards or downwards in the direction of the z axis as noted and discussed elsewhere herein. Thus, standard valve assemblies may be used and rotatably positioned and then attached to various standard bridge configurations to create a wide variety of valve/bridge combinations. A further variety of spout tube designs may be used with the valve/bridge combinations. Thus, use of only a few standard parts enables a modular approach to more automated and simple manufacture of faucet assemblies in a wide variety of design configurations and differing sizes. It further provides easy formation of hybrid faucet assemblies which are at least partially polymeric for ease of manufacture and cost reduction.

In one embodiment herein all or a portion of a separate valve assembly may be attached to a bridge component, either removably or permanently, so as to form a primarily metallic internal water way assembly having shank(s), valve water way portion(s) and the bridge formed of a metallic material. In another embodiment, a shank and valve water way portion, each formed of a metallic material may be provided as a valve assembly for use with a bridge formed of a polymeric material. In further embodiments, varying bridge components (formed of metallic material and/or polymeric material) may be provided to work with varying valve assemblies, such as, for example valve assemblies which may include (a) a shank and valve water way portion that each include polymeric material which can communicate with standard polymeric inlet/outlet hose(s); or (b) a metallic shank sleeve connectable to inlet/outlet hose(s) with a valve water way portion having a polymeric outsert-molded material overlying or forming the valve water way portion and/or forming an interior layer on the interior surface of the shank.

The invention further provides a spout tube which is preferably polymeric and can be made flexible in nature if desired. The spout tube when assembled to the bridge herein extends from a spout inlet along the bridge. The bridge, in a preferred embodiment herein, is positioned within the internal water way assembly such that it is mechanically joined to or engaged within the valve water way portion of the valve assembly. This allows for an interior water way assembly which can be adjusted prior to assembly so as to fit within a variety of outer cover plate designs or faucet exteriors, while not requiring separate interior constructions for each such exterior design modification. This ability to use a basic internal water way assembly, but vary the positioning for different cover plates using a bridge that can work with the spout tube so that it is repositionable in assembly, enables the spout outlet to be repositioned or modified in varying ways to achieve a variety of spout reaches and heights and varying cover plate designs.

The manufacture of a separate side valve assembly(ies) in a hybrid faucet assembly provides a more universal internal water way assembly in embodiments herein which is also beneficial, as coupling such assemblies to various differently sized or configured sink fittings can be accommodated by using such universal valve assemblies with different center bridge configurations and sizes, for example, using the valve assemblies with different bridges to form both four inch and eight inch faucet water way assemblies.

Incorporating polymeric materials in the internal water way assemblies of the faucet assemblies herein not only provides flexibility in design as noted above, but contributes to reduction in the amount of brass and/or copper material used for various parts such as the water way, resulting in reduced product costs, reduced weight and, easier maintenance.

Thus, the embodiments herein provide a modular approach that allows for simple molded internal water way components and eliminates the need for complex internal water way molding techniques such as plastic injection with soluble cores or gas assist molding processes and/or various primary insert and secondary molding techniques. It further contributes to a lower overall product manufacturing and consumer costs.

Referring now to the Figures herein, preferred embodiments of the invention will be described. In the drawings, words such as "inner" and "outer," "upper" and "lower," "interior" and "exterior," "forward" and "backward," "front" and "back," "left" and "right," "upward" and "downward" and words of similar import are intended to assist in understanding the preferred embodiments of the invention with reference to the accompanying drawing Figures with respect to the orientation of the faucet assembly as shown, and are not intended to be limiting to the scope of the invention or to limit the invention scope to the preferred embodiment as shown in the Figures.

In one embodiment herein, as best shown in FIGS. 1-13, a faucet assembly, generally referred to herein as faucet assembly 10, is shown which is a lavatory faucet assembly. This embodiment should not be considered to be limiting and is for illustration purposes in understanding the nature of the invention. In a general sense, the faucet assembly includes a cover plate herein shown as cover plate 12, an internal water way assembly 14 and one or more faucet handles 16. The cover plate as shown is in the nature or format of a lavatory faucet and is a multi-part cover plate. However, the cover plate 12 may have a variety of configurations and shapes, without limitation herein and may be unitary if desired. It may also be shaped so as to be suitable for use in a kitchen faucet, industrial sink faucet, laundry sink faucet or any other faucet assembly configuration.

The cover plate 12 as shown has a configuration for use with a lavatory faucet design in which for assembly purposes it is convenient to form an outer shell for housing an assembled internal water way by using two separate cover plate pieces. However, it should be understood to one skilled in the art in view of this disclosure that a one-piece cover plate or lower cover plate over just the bridge and valve assemblies with a separate covering for the spout tube may also be used as exemplified further below in this disclosure. A top cover plate 18 and a bottom cover plate 20 are preferably configured so that when assembled, they have a smooth mating appearance. The cover plate 12 defines an interior surface 22 on both plates that defines an interior space 26 in which at least the bridge and valve assemblies of the internal water way assembly are generally situated, and as shown here, also accommodates the spout tube.

The exterior surface 24 of the cover plate may be formed so as to be of a variety of preferably decorative materials, whether a metallic cast finish, a plastic molded design color or metallic look or the like. The cover plate may also be a molded metallic structure, but is preferably a molded polymeric material having a cast metallic finish. Such materials are well known in the art of exterior coverings for faucet assemblies, and any such suitable outer faucet cover material may be used to form the pieces of the cover plate, such as the polymeric and composite materials listed elsewhere herein. Preferably, the cover plate is formed of a polymeric material such as a polyoxymethylene (POM), a polyamide (PA), a polyphenylene sulfide (PPS), or a polyphenylene oxide (PPO) or combinations, copolymers or functionalized forms of these polymers of various other polymers as listed elsewhere herein.

Figure 13:
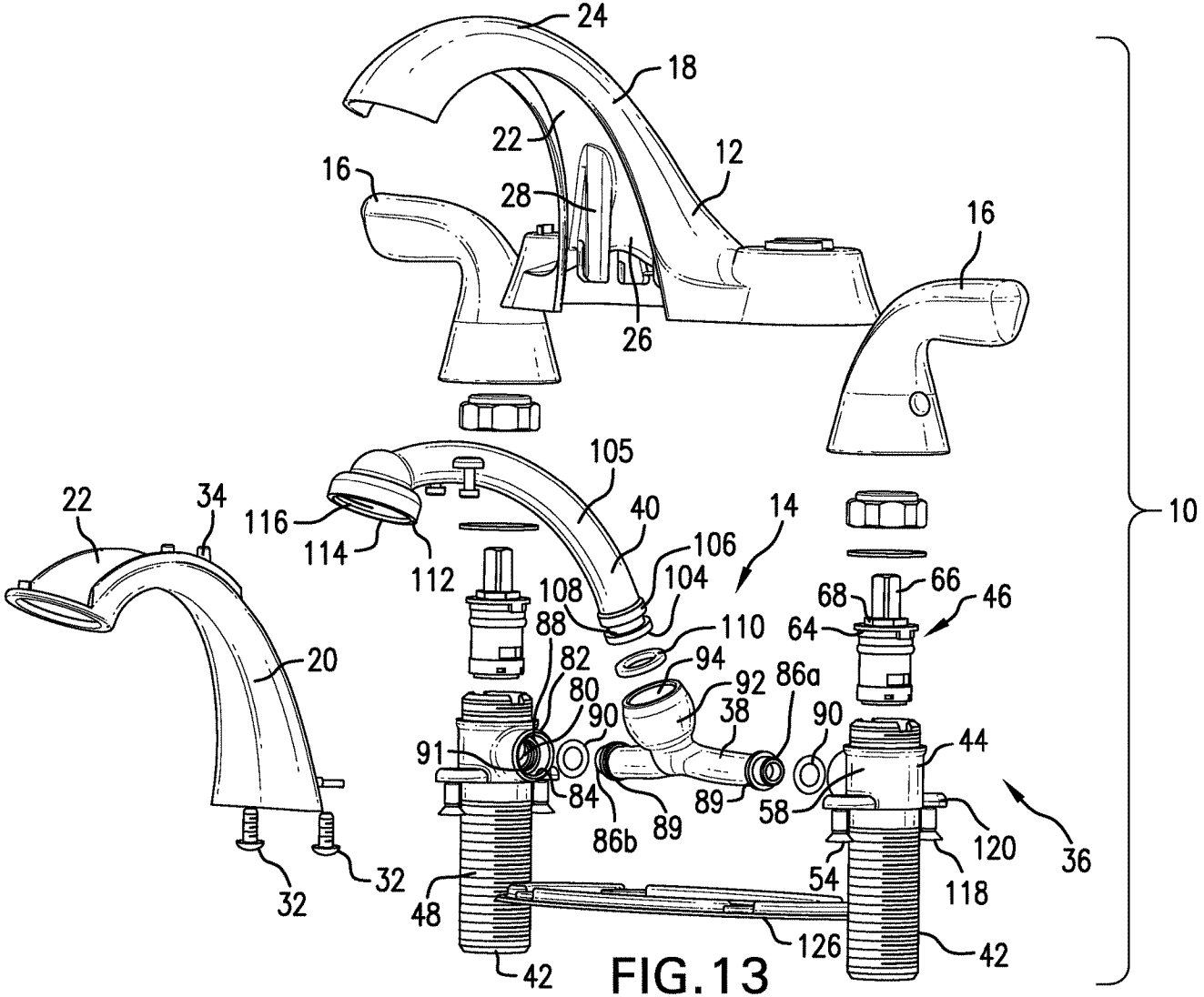
FIG. 13 is a perspective exploded view of the faucet assembly of FIG. 1.

The top and bottom cover plates 18, 20 of the assembled cover plate may fit together in a variety of ways. Either of the cover plates may have a bore formed in the structure to receive a mating and interlocking piece, or a fastener, dowel, snap-fit piece and the like. As best shown in FIG. 13, the top cover plate is provided with female receiving bores 28 having an interior surface 30 configured to receive a male fastener such as fasteners 32. The fastener(s) may pass through and/or be situated in a receiving hole in the bottom cover plate or elsewhere in the water way assembly so as to fit within the mating bore 28 in the interior surface 30. Alternatively, a mating projection(s) may be formed in a surface of the lower plate or attached to the water way assembly instead of a separate fastener(s), which projection(s) would be sized and configured to be received in the receiving bore(s) in the top cover plate. The location of the bore(s) and the fastener(s) or projection(s) that can fit within the receiving bore could be reversed as well in terms of whether each is located on the top plate or the bottom plate. It should also be understood to one skilled in the art, based on this disclosure, that any suitable interlock feature for mating polymeric cover plate parts may be used within the scope of the invention, including peripheral tabs or other mating interlock features to facilitate a tight fit such as an interlocking feature 34 in the form of a tab shown in FIG. 13. Further, it should be understood that while two mating plates are preferred for formation of the cover plate 12, it can also be formed as a molded unitary structure or of a lower base plate cover and an upper spout tube cover.

Figure 9:
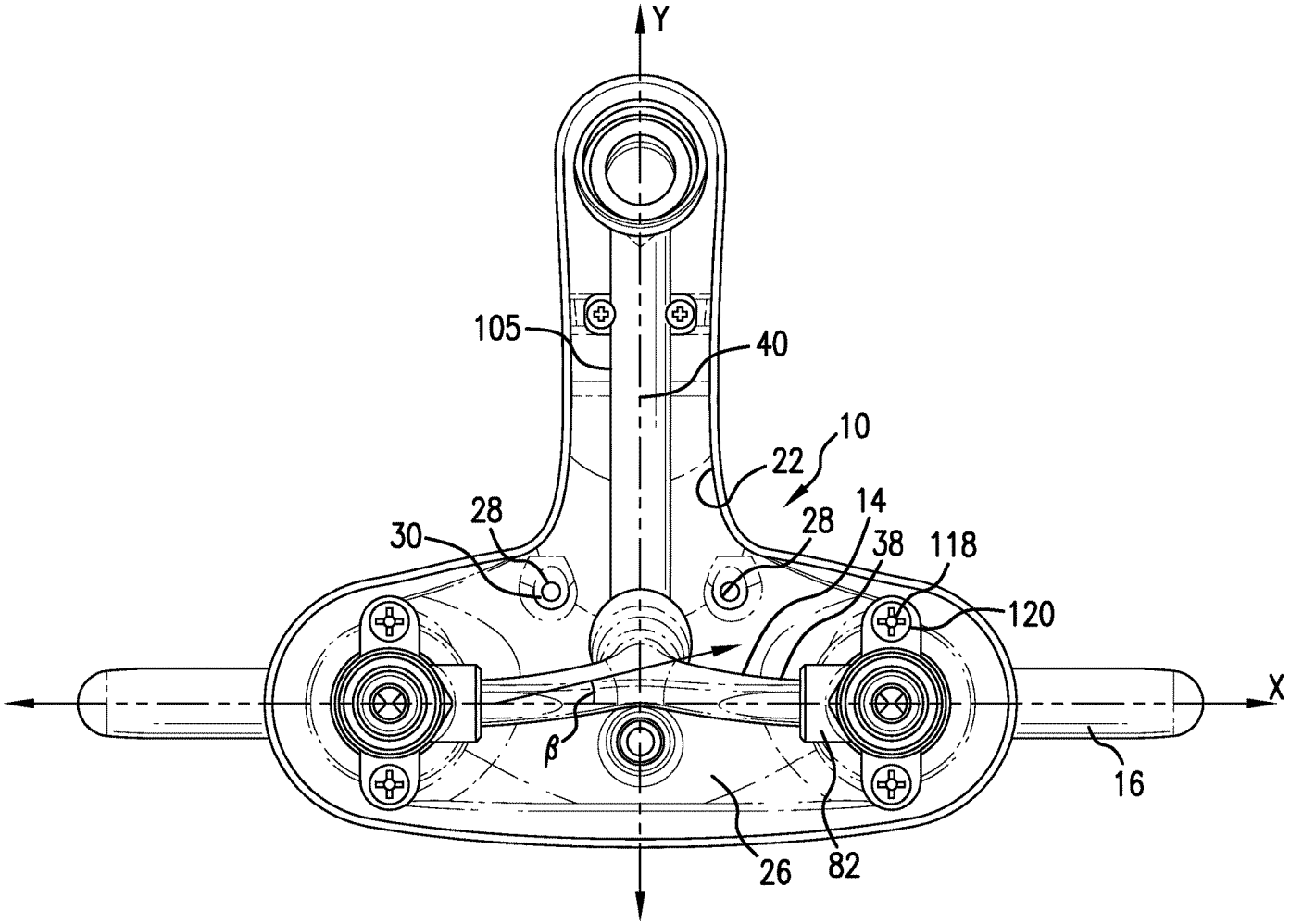
FIG. 9 is a bottom elevational view of the faucet assembly of FIG. 1 having a bottom plate removed from the cover plate and the putty plate removed leaving just the top plate on the assembly.
Figure 10:
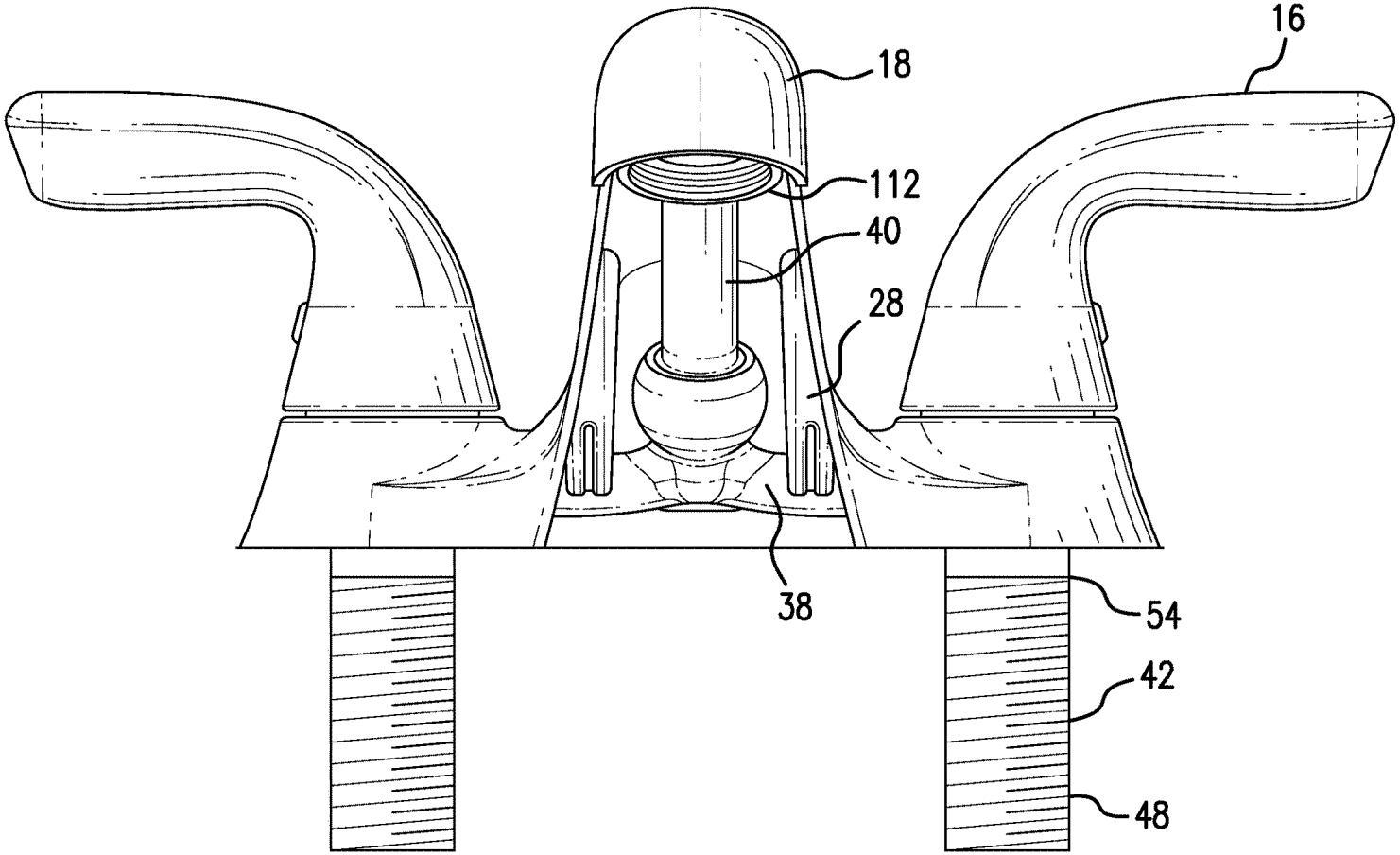
FIG. 10 is a front elevational view of the faucet assembly as shown in FIG. 9.
Figure 11:
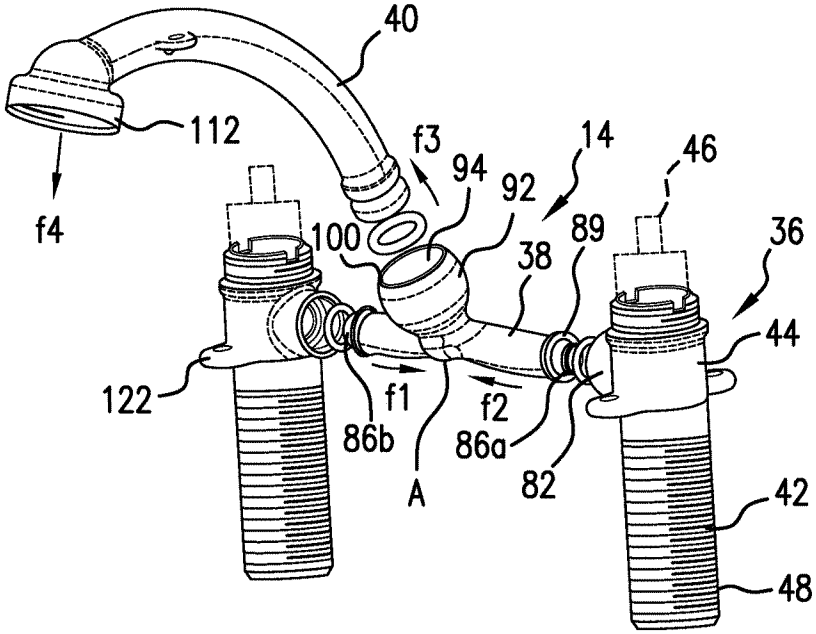
FIG. 11 is an exploded perspective view of an internal water way assembly in the faucet assembly of FIG. 1 having the valve cartridges removed.
Figure 12:
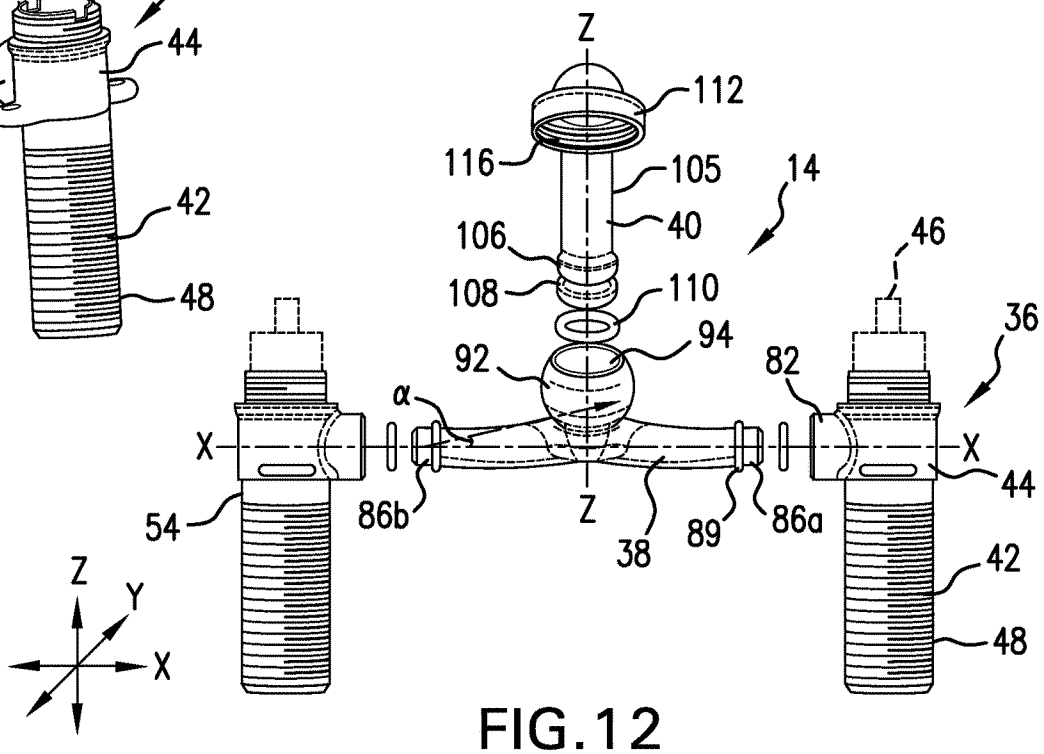
FIG. 12 is an exploded front elevational view of the internal water way assembly of FIG. 11.

As shown in various cross-sectional views in FIGS. 2-6, the exposed bottom view of the faucet assembly without the bottom plate in FIGS. 9 and 10 and in the exploded views of FIGS. 11-13, the faucet assembly 10 also includes an internal water way assembly 14. The internal water way assembly 14 preferably generally includes one or more valve assembly(ies) 36, a valve cartridge(s) 46, a bridge 38 (which may be a single piece or a multi-part assembly) and a spout tube 40.

The valve assembly further may incorporate one or more shanks 42, and one or more valve water way portions 44. The valve cartridge(s) 46 is/are then seated in the valve water way portion(s) of the valve assembly(ies). A shank 42 in the valve assembly herein may be formed in a standard shank configuration preferably having a partially or fully threaded exterior surface 48. Such surface can then be used to mount the faucet assembly 10 to a mounting surface M using any suitable mounting nut 50 as shown in FIG. 1. A standard nut or a quick push and turn nut as disclosed, for example, in U.S. Patent Publication No. 2010/0272503 A1, incorporated by reference herein in relevant part, may be used for installation against a mounting surface. Hot and/or cold water inlet tubes as are known in the art may also pass through the longitudinally extending interior passageway 52 within the shank for connecting the faucet assembly to a water source. Such tubes are known in the art. Alternatively, the shank may be molded of a polymeric material so as to have an internal configuration for desired flow patterns, flow pressure or degree of turbulence. The shank may also be connected directly to a standard water supply hose for supplying hot or cold water if two shanks are used, or for housing a mixing valve which may also then be connected to hot and cold inlet hoses for a single handle faucet. Such connections are well known in the art and so are not explained in detail herein.

Each shank 42 in each valve assembly 36 may be formed together with the valve water way portion 44 as a single unitary body, or may be a separate piece to which a separate valve water way portion 44 may then be attached such as by molding, welding or mechanical attachment. As a unitary structure, the shank 42 and valve water way portion 44 may be formed of a single material and shaped or molded as a single part. In doing so, the combined structure of the shank and valve water way portion could be formed of a material which is a metallic material, such as a metal or metal alloy, preferably brass, copper, steel or plated steel. Alternatively, they combined unitary structure may be molded from a polymeric material. In addition, a metallic base structure may be formed over which a polymeric material may be provided to the exterior and/or interior surfaces if desired, such as a polymeric outer covering on a metallic base in the valve water way portion or a polymeric lining in a metallic shank.

Polymeric materials used may be an unfilled polymer or a filled polymeric or composite material having a powder type or fibrous reinforcement. Various polymer and/or hard rubber materials may be also used (e.g., polystyrene-butadiene-styrenes (SBS), polyacrylonitrile-butadiene-styrenes (ABS), polyamides (PA), polyimides (PI), polyarylenes (polyetherether ketone (PEEK), polyether ketone (PEK), polyether ketone ketone (PEKK) and the like), polyethylene sulfones (PES), polyetherimides (PEI), polytetrafluoroethylene (PTFE), fluoroplastics (FEP and PFA), olefinic rubbers, polyethylenes (PE), polypropylenes (PP), polyvinylchloride (PVC), polyoxyalkylenes (i.e., polyacetals) such as POM, polyoxyethylenes (POE), polyoxybutylenes (POB), polyphenylene sulfide (PPS), polyphenylene oxide (PPO), etc., styrene-maleic-anhydrides (SMA)). The shank and valve water way portion may be formed of other similar molding materials, composites, blends and/or copolymers of these materials, provided the materials provide adequate strength and properties for functioning in the faucet assembly 10 herein. Composite materials may include a combination of polymeric materials as noted above with fibrous and/or particulate materials such as glass fibers, carbon fibers, aramid fibers, Kevlar®, mica, carbon powder, and other fillers known in the art. As noted above, preferred materials include PA, POM, PPS and PPO and copolymers, combinations and functionalized polymers of these materials.

It is also within the scope of the invention as noted above that the shank and valve water way portion are separate pieces combined into a single structural unit. In one embodiment, the shank may be formed of a metallic material and the valve water way portion then molded over the upper portion 54 of the shank 42. Techniques such as outsert molding or other heating molding processes for forming a valve water way portion 44 on an upper portion 54 of a shank 42 may be used. In preparing such a structure, it is preferred that the polymeric material used to form the valve water way portion 44 is also coated on the interior surface 56 of the shank 42 to form a smooth interior and a uniform transition from the longitudinally extending interior passageway 52 of the shank to the interior of the valve water way portion 44. Thus, there are multiple options for formation of the valve assembly pieces so as to provide a variety of design options.

The shank and/or valve water way portion 44 of the valve assembly 36 are preferably formed as a separable assembly that may be attached permanently or removably to the remainder of the internal water way assembly 14 and can be configured to seat a variety of valve cartridges. The valve assemblies may be further molded or formed so as to connect the valve water way portion 44 to the bridge 38 and shank forming a three-piece unitary structure after the bridge is rotatably positioned. Such molding may be done to enhance structural integrity. In the preferred embodiment shown herein, the bridge 38 and the valve water way portion 44 are mechanically joined or engaged and the bridge is a separate piece from the valve assembly 36. By maintaining the valve assembly as a separate feature that may be combined mechanically to the bridge, modular water way assemblies may be formed wherein a standard valve assembly may be used, and also incorporate various types of cartridges if desired. The standard assemblies can be interchanged with different size and shape bridge configurations to form multiple variations of water way assemblies. By rotating the bridge before assembly to different positions, the water way assembly can attach to various shapes of spout tubes using a variety of heights and elevations depending on where the spout receiving portion of the bridge is aligned with the spout tube.

The valve water way portion 44 may have a variety of configurations on its exterior for either aesthetic or design reasons, but the exterior surface 58 of the valve water way portion 44 is preferably generally cylindrical and shaped so as to fit over and be positioned on the upper portion 54 of the shank 42. Internally, the interior surface 60 of the valve water way portion 44 should be configured to define a valve seat 62. The valve seat is preferably configured to receive water from a water source that would flow through the passageway in the shank from a water source into the valve seat in the valve water way portion. The shape or configuration of the valve seat can vary depending on the valve cartridge 46 to be used. A valve cartridge 46 may be any of a variety of standard commercially available or otherwise manufactured valve cartridges known in the art or to be developed. The valve cartridge 46 shown herein is preferably a valve cartridge having the design and configuration as described in U.S. Patent Application Publication No. 2012/0273075 A1 which is commonly owned with this application, and the disclosure of which is incorporated herein by reference in relevant part with respect to the design configuration of the cartridge. Such a cartridge is also commercially available from American Standard Brands of Piscataway, N.J. as the Washerless Ceramic Disc ECO™ Valve or Lifetime ECO™ valve. Thus the valve seat would be configured to securely hold the cartridge and to have an opening in the valve seta in communication with an opening in the cartridge for receiving water into the cartridge. The precise configuration of the valve seat and cartridge combination as well as any interlocking or sealing arrangements can be varied within the scope of the invention and should not be considered limiting.

Figure 5:
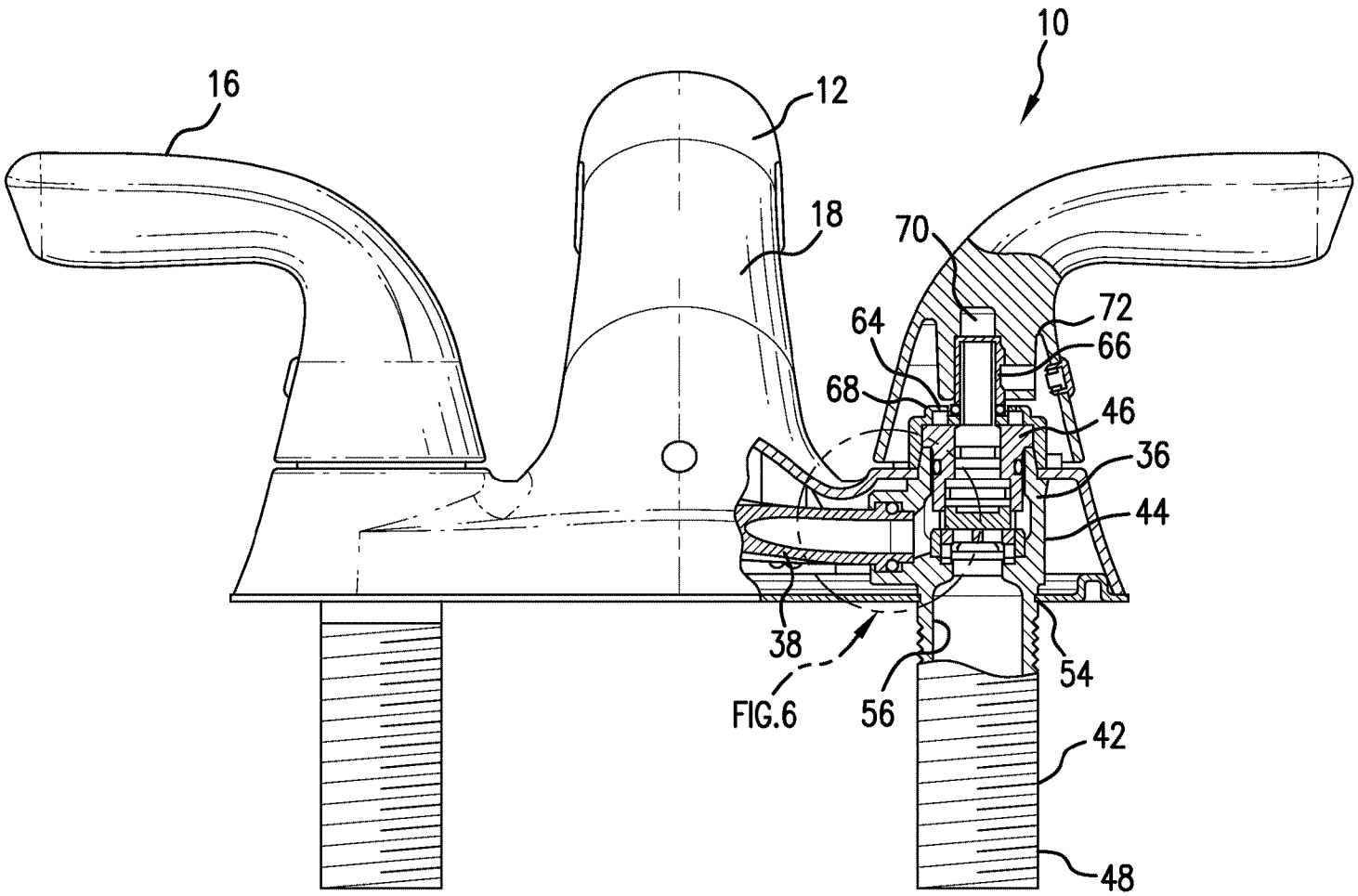
FIG. 5 is a rear elevational having a partial cross-sectional view taken along line 5-5 of FIG. 4.

The cartridge 46 as best shown in FIGS. 5 and 13 may be actuated by an upper end 64 thereof. The upper end of the cartridge is preferably provided with features, such as a spindle 66 and/or stops 68, so that the faucet handle 16 can have an interior surface 70 with corresponding features, such as feature 72 shown in FIG. 5 for example, that operably move the valve cartridge. As shown, a feature(s) 72 operates to engage the valve cartridge spindle 66 so that it may be moved from an open to a closed position and/or into a partially open or partially closed position for adjusting overall water flow and temperature between hot and cold water flow. The valve cartridge thus moves through different positions so as to control flow through the internal water way assembly. The handle(s) also are preferably positioned as shown to be outside the interior space defined by the interior surface of the cover plate. Such cartridge and handle configurations are known in the art and any suitable cartridge/handle combination designed to fit in a valve seat as described herein that is known or to be developed may be used within the scope of the invention.

Figure 6:
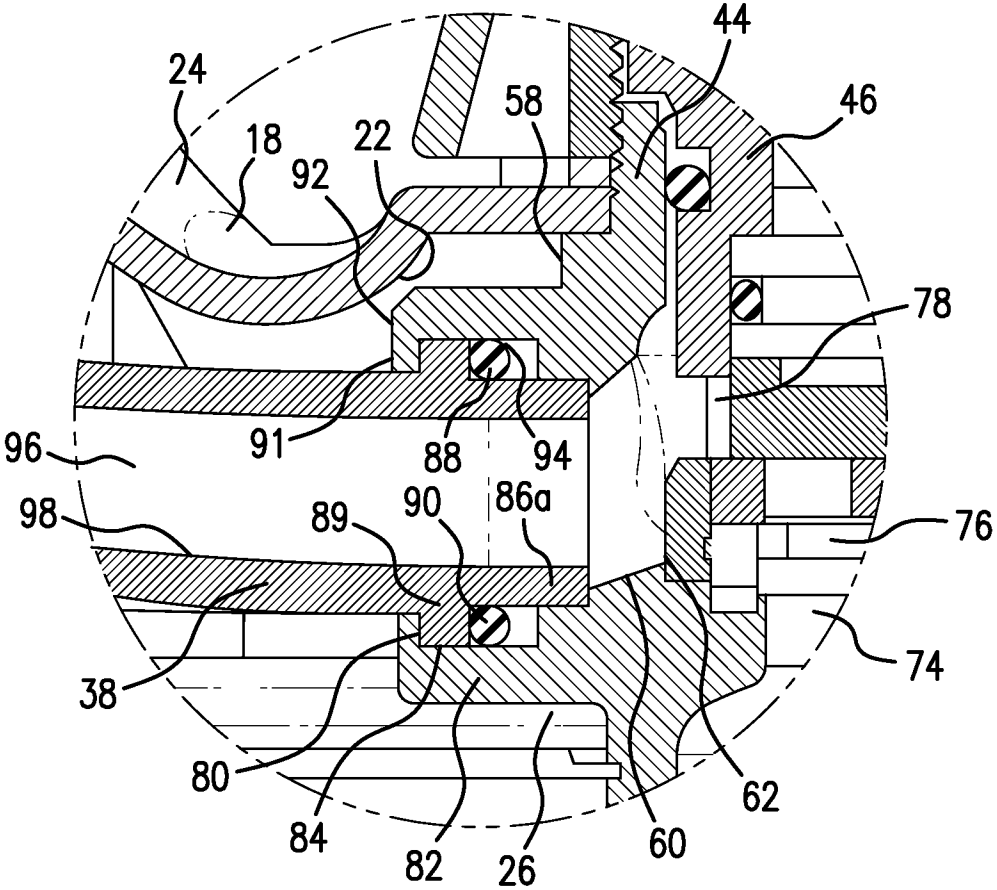
FIG. 6 is an enlarged portion of FIG. 5 showing engagement of one end of a bridge with a valve water way portion of the valve assembly in the embodiment shown in FIG. 1.
Figure 7:
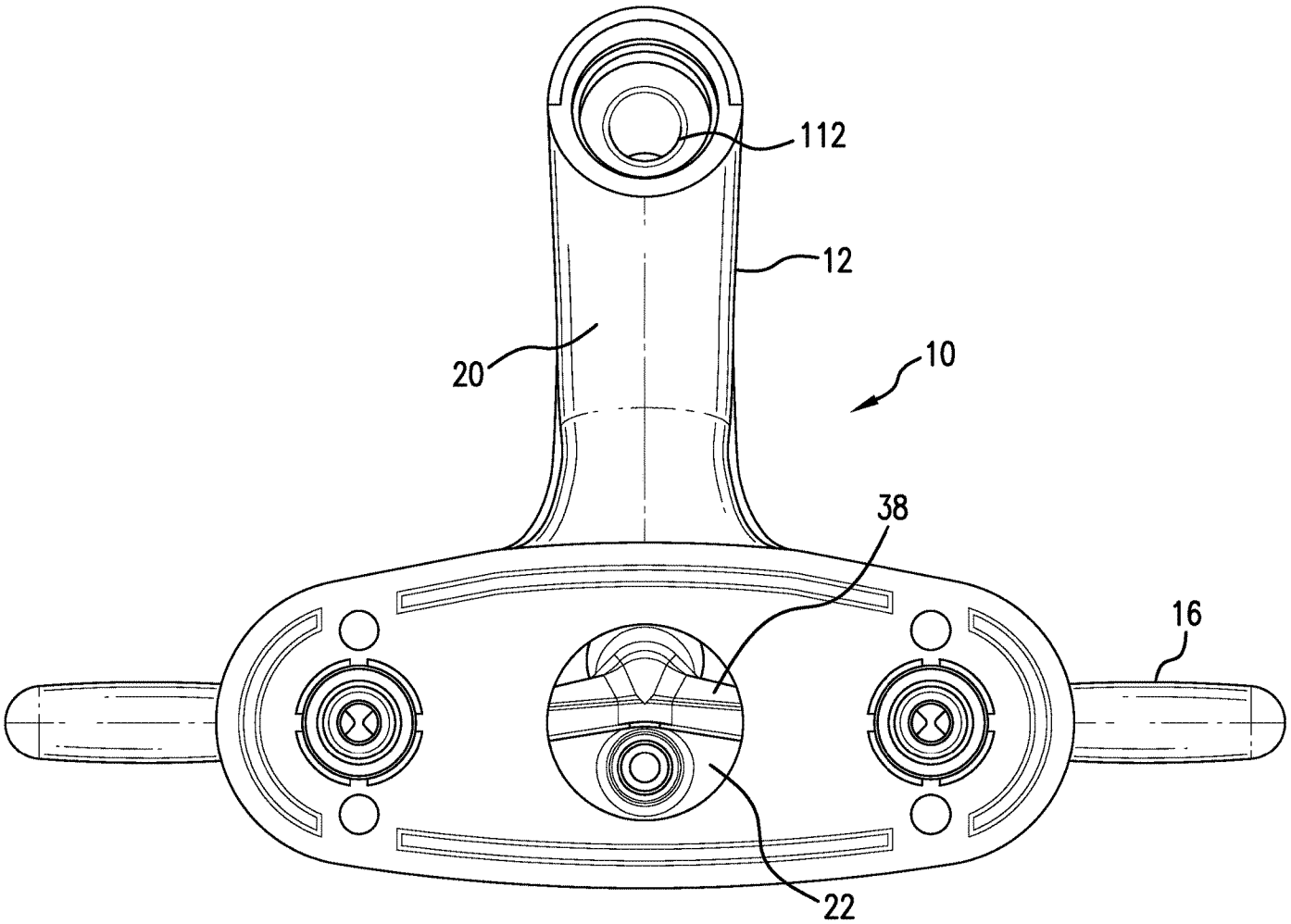
FIG. 7 is a bottom elevational view of the faucet assembly of FIG. 1.
Figure 8:
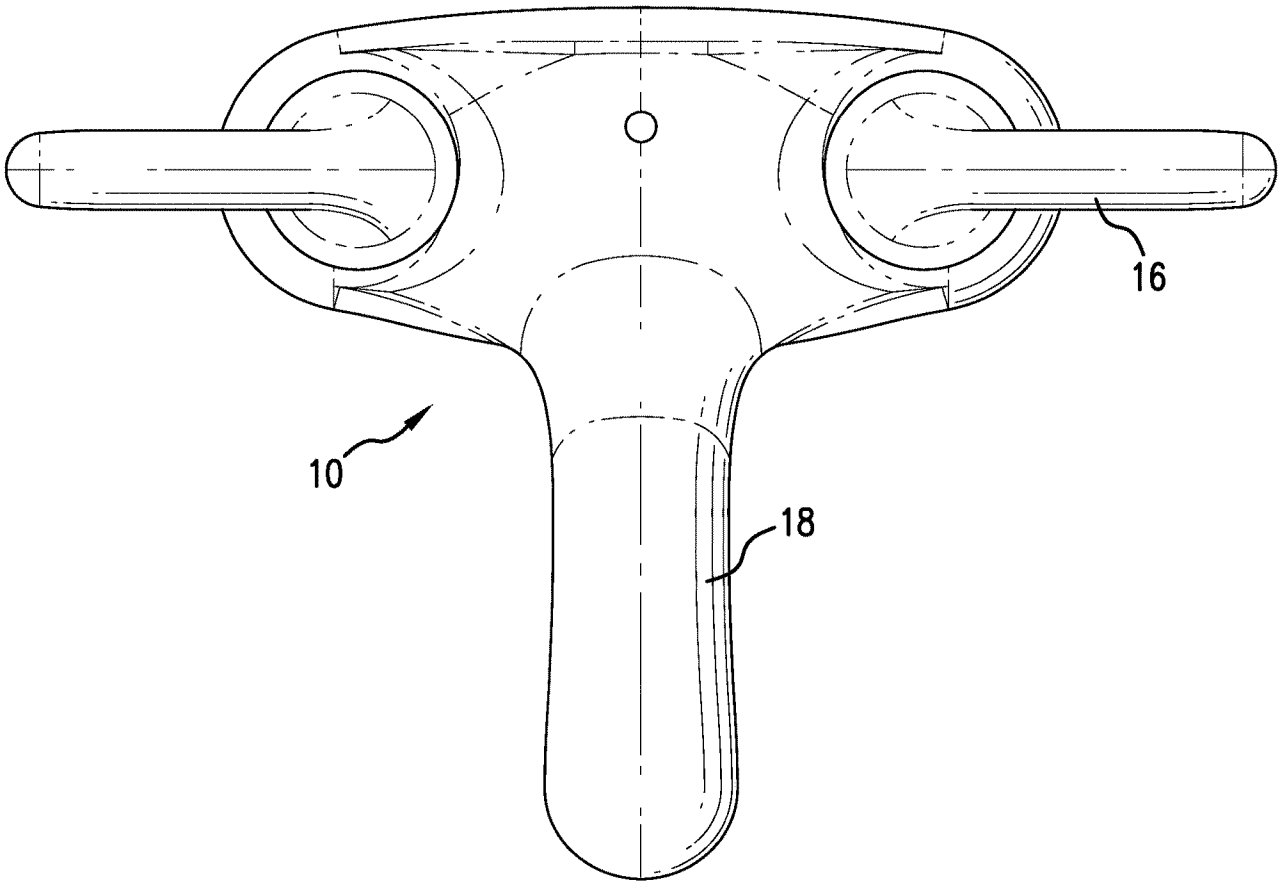
FIG. 8 is a top elevational view of the faucet assembly of FIG. 1.

As best shown in FIG. 6, the valve water way portion 44 further includes an inlet 74 to receive water flow from the longitudinally extending passageway 52 of the shank 42. Water enters the valve water way portion inlet 74 and enters the valve seat 62. Water passes into the valve seat 62 and into the inlet 76 of the valve cartridge 46. The inlet 76 of the valve cartridge is situated and configured for receiving water entering the valve seat if and when the valve cartridge is in an open position. After passing through the cartridge 46 when open, water flows out of at least one side cartridge outlet 78 and flows within the interior of the valve seat. The valve water way portion 44 includes in the embodiment shown a transversely extending outlet passageway 80 which is preferably at least partially within a bridge receiving portion 82 extending outwardly towards the center of the assembled internal water way after the valve assembly is installed and the assembly completed. If the valve water way portion is alternatively formed and then molded to the bridge, the transversely extending outlet passageway leading water flow from the valve water way portion could be heat molded onto the bridge so that flow from the valve water way portion goes directly into the bridge.

As shown in FIG. 6, the bridge receiving portion 82 has an interior surface 84 which is configured for engaging and/or joining to one end 86*a* of the bridge. The surface 84 can have mating features for a snug fit and preferably includes a groove 88 for receiving a seal 90 such as an o-ring or gasket therein. The outlet(s) 78 of the valve cartridge 46 are thus in fluid communication with the outlet passageway 80 of the valve water way portion 44, and more specifically with the interior of the bridge receiving portion 82.

The water leaving the bridge receiving portion(s) 82 flows into the open end(s) 86*a*, 86*b* of the bridge 38 such that the outlet passageway(s) 80 of the valve water way portion(s) 44 is/are in fluid communication with the passageway 96 of the bridge 38. The open end 86*a* of the bridge is positioned within the bridge receiving portion 82. The bridge 38 is preferably generally transversely extending across the faucet assembly 10 as is the bridge receiving portion 82 for a more laterally aligned standard faucet, but it is within the scope of the invention that the bridge could be configured so as to extend upwardly in a more curved or angled configuration, backwardly, forwardly, upwardly or downwardly with respect to the x, y and/or z axes of the bridge within the assembly (see FIG. 12). Preferably, however, the bridge 38 is formed so as to generally extend from side-to-side or generally transversely within the faucet assembly, wherein "generally transversely" accommodates variations in angle but generally extends side-to-side. The bridge as best shown in FIGS. 9, 10, 12 and 13 has slight bends. Such bends may be provided for design purposes so as to follow the outer configuration of the faucet assembly and/or for flow purposes for directing flow from the valve water way portion and bridge receiving portion into and through the bridge and upwardly out of the bridge into the spout tube. The bridge may also be provided with curves or outer features if desired.

As shown in FIG. 12, the bridge 38 may have a slightly bent angle $\alpha$ of greater than 0° to about 10° between the x and z axes (i.e., an upward vertical angle to the horizontal or transverse axis (x-x) of the apparatus and/or to the x-y horizontal plane) and as best shown in FIG. 9 in a bottom plan view a backwardly extending angle $\beta$ of greater than 0° to about 10° between the x and y axes. As shown, a slight curve is also provided. This is just one of several such configurations that the bridge may have, and should not be considered limiting to the scope herein. Depending on the configuration of the bridge, the bridge receiving portion of the valve water way portion may be designed to have a slightly angled arrangement with respect to the body of the valve water way portion to more smoothly mate with the bridge if desired for design purposes.

The bridge also has a passageway therethrough extending generally transversely from one end of the bridge, extending into the interior passageway within the spout receiving portion when there is only one valve assembly, or extending further and ending in an opposite end of the bridge as shown. The opposite end of the bridge 86*b* is thus configured in the embodiment shown to be placed in a second valve water way portion of a second valve assembly when two valve assemblies are used. As shown, the bridge 38 has an internal passageway 96 defined by its interior surface 98 and extending through the bridge from one inlet end 86*a* to the other 86*b*. The open inlet ends of the bridge are in communication with the passageway 96 through the bridge 38. The passageway 96 receives water from the outlet passageway 80 of the valve water way portion 44.

If two valve assemblies are used as shown with two valve water way portions, the second opposite end 86*b* of the bridge engages with or is joined to a second bridge receiving portion 82 on a second valve water way portion 44. It may be engaged or joined so as to be releasably attached or permanently attached. To accommodate this, the exterior surface 97 of the bridge 38 at the ends 86*a*, 86*b* can be configured to fittingly engage, preferably snugly the interior surface 84 of the bridge receiving portion 82 or may have features for interlocking with similar mating features on the interior surface 84 of the bridge receiving portion. As shown, a seal 90 is seated between each of the ends 86*a* and 86*b* in the groove 88 formed in the interior surface 85 of the bridge receiving portion 82 for sealing engagement of the bridge receiving portion 82 and the bridge 38. Further, an outwardly extending flange 89 is positioned around the exterior surface 97 of the bridge at the ends 86*a*, 86*b* such that when each end 86*a*, 86*b* is positioned within its respective bridge receiving portion 82 of each valve water way section 44, the flange helps seal and lock against the edge 91 of each of the bridge receiving portions 82. The inlet ends of the bridge may also be permanently attached by an adhesive or the like to the interior surface 85 or edge of the bridge receiving portion. In addition, the configuration of the ends 86*a*, 86*b* and the bridge receiving portions 82 may have a flipped configuration in which the bridge receiving portions are instead configured to fit within the bridge ends instead of the other way around so that the bridge receiving portions fit within the respective ends of the bridge. In such an arrangement, the sealing groove may be formed within the ends of the bridge and the interlocking features reversed. Interlocking features may include flanges as shown, snap-fittings, locking tabs, interlocking mating features, slots and tabs, bayonet lock connectors, and the like, and the manner in which the pieces interlock or fit together should not be considered limiting to the invention.

Water flowing through each of the outlet passageways 80 of each of the opposite valve water way portions 44 travels toward the center such that each of the flow paths flow toward each other as shown by flow arrows $f_1$ and $f_2$ in FIG. 11 until the flow meets, which as shown is at a center area A of the bridge 38. The merged flow from each valve assembly then enters the internal passageway 94 of the spout receiving portion 92 of the bridge and flows upwardly into the spout tube 40 along flow path $f_3$ shown in FIG. 11. The interior surface 100 of the spout receiving portion 92 of the bridge defines an internal passageway 94 extending through the spout receiving portion 92 that is open to the passageway 96 of the bridge at one end and open as an outlet at the other end for allowing flow from within the bridge passageway 88 to exit the bridge 38 through the internal passageway 94 of the spout receiving portion 92.

The bridge exterior shape may be formed so as to have a variety of external cross-sectional shapes, including generally round, elliptical, oval, square and the like. Similarly the various internal passageways in the bridge receiving portion of the valve water way body and within the bridge may have a variety of cross-sectional shapes that may be the same or different from the exterior cross-sectional shape of the exterior of the bridge. Thus the exterior may be formed for manufacturing convenience and fit within the cover plate, yet may have a configuration in the interior of the passageway in cross-section that is best suited for desired flow characteristics, for example a more generally round interior cross-section.

Figure 4:
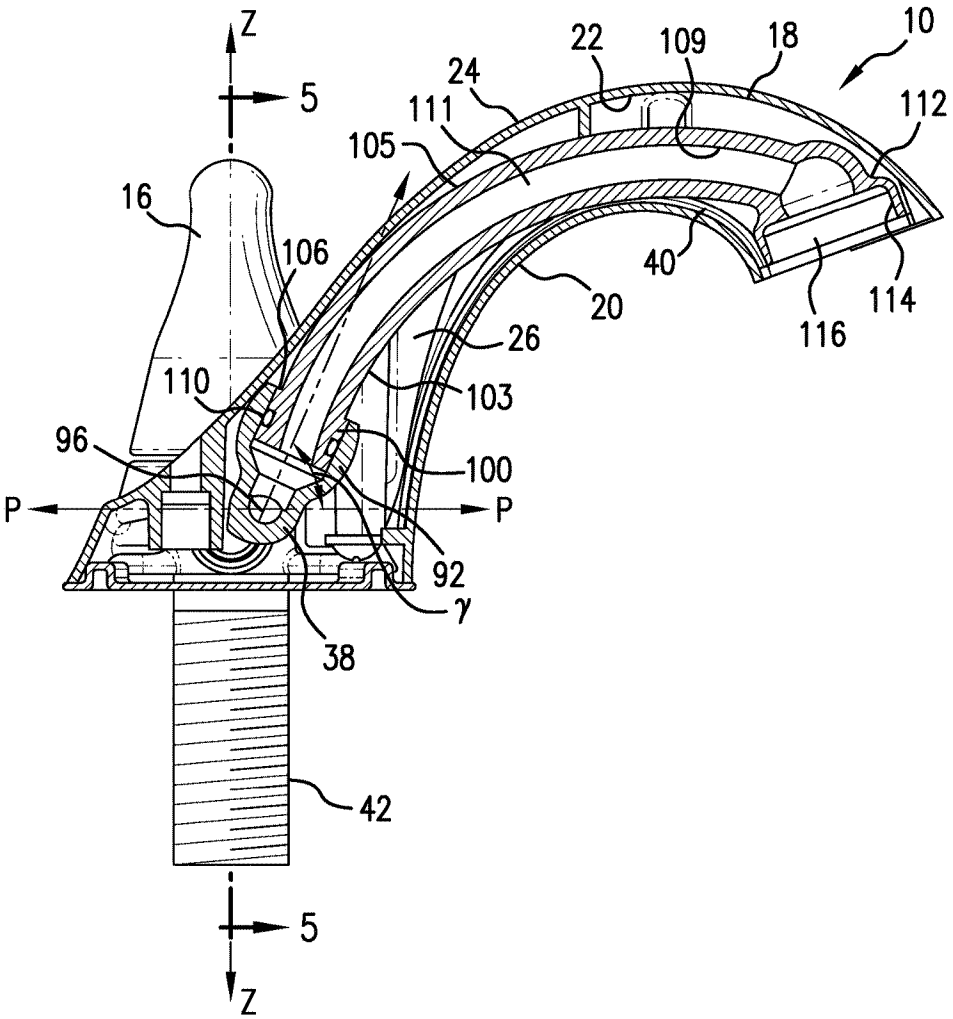
FIG. 4 is a left-side cross-sectional view taken along line 4-4 of FIG. 1A.

The spout tube of the faucet assembly can be formed of a variety of polymeric materials including composites, or of metallic materials as noted above herein. Preferably the spout tube is formed of a moldable and/or flexible polymeric material. If a flexible material is used instead of a more rigid polymeric molded material, the spout tube can also be manipulated so as to fit within the interior space of the cover plate. Alternatively, it can be pre-molded to fit using a less flexible molded material and a pre-formed design configuration. As shown, the spout tube is molded so as to generally conform so as to fit efficiently within interior space 26 formed by the interior surface 22 of the cover plate 12 in the area B as shown in FIG. 1 where the top and bottom cover plates 18, 20 meet to form the spout portion 102 of the cover plate 12. The spout tube has an inlet end 104 open to flow which inlet end is configured to be positioned in the spout receiving portion 92. With reference particularly to FIGS. 4 and 13, preferably, if molded, the spout tube has exterior features on the exterior surface 105 of the spout tube at the inlet end 104 thereof for engaging with and/or joining the inlet end 104 to the interior surface 100 of the spout receiving portion 92. As shown, the faucet assembly 10 includes an example of a locking end 106 having a groove 108 therein for receiving a seal 110 such as an o-ring or gasket in the groove 108. However, other locking features or mating features, including locking plates or flanges to hold the inlet end of the spout tube within the spout receiving portion, may be used and/or formed into or on the exterior surface 105 of the spout tube within the scope of the invention. It is also within the scope of the invention that the bridge receiving portion fits within the inlet end of the spout tube in a reverse configuration wherein the bridge receiving portion forms the female mating end of the connection and o-ring placement and/or locking features are reversed.

Once the spout tube 40 is seated within the spout receiving portion 92, flow through the internal passageway 94 of the spout receiving portion leaving the bridge also flows within the inlet end 104 of the spout tube. Thus the inlet end 104 is in fluid communication through the spout receiving portion 92 with the passageway 96 of the bridge 38. The spout tube 40 also has a second, outlet end 112 for delivering water out of the faucet assembly when in use. The outlet end 112 may be configured to accommodate an internal aerator, sprayer, an open flow/spray flow diverter and/or extendible hose for a pull-out sprayer feature depending on the faucet assembly intended use and design. As shown, an interior surface 114 of the outlet end 112 is configured to have threads 116 for receiving an end fitting (not shown) such as an aerator or the like with similar threads. However, any end fitting receiving or other outlet end configuration is within the scope of the invention hereof and the outlet end configuration should not be considered limiting to the invention. Flow thus enters a passageway 111 through the spout tube defined by the interior surface 109 of the spout tube 40 at the inlet end 104 along a flow path according to arrow $f_3$, travels through the passageway 111 of the spout tube and exits the faucet at the outlet end 112 along a flow path shown by arrow $f_4$ shown in FIG. 11 in a generally downwardly direction. However, the direction of the flow may be altered by end fittings, aerators, spray heads, diverters and the like.

An important benefit of this embodiment of the invention wherein the bridge is a separate component from the valve assembly(ies) is that when not pre-assembled, a separate valve assembly structure can be fitted on either end of the bridge and the bridge can be aligned by rotatably positioning the spout receiving portion before being attached to the valve assembly so that the spout receiving portion of the bridge can be axially located and positioned at different angles to enable the spout to have a configuration that will fit within the interior space defined by the cover plate. For example, the spout tube may be designed to extend upwardly and curve downwardly near to the outlet end as shown in FIG. 4, or the spout tube may be shaped more like a U-shaped longer spout for a kitchen faucet, lower in height or taller in height and of a variety of shapes without requiring a whole separately molded assembly for each faucet water way assembly design configuration.

The invention can include a variety of spout tubes that work with varying configurations of the bridge. For example, the bridge 38 may include a spout receiving portion of various configurations for attachment of the spout tube, and also can be angled for combining with differing configurations of spout tubes by the rotatability of the bridge when forming the water way assembly from the bridge and valve assemblies. Thus, the spout receiving portion can rotate (in a multi-part bridge), or the entire bridge may rotate (in a single part bridge) when forming the assembly. Rotation occurs around the horizontal or transverse x-x axis through the bridge and water way assembly (shown best in FIG. 9) so that the spout tube 40 when installed has a lower portion 103 that stems from the spout receiving portion, and the spout receiving portion 92 forms an angle $\gamma$ of about 0° to about 90° between the z axis through the faucet and they axis or between the plane of the x-y axes, shown as plane P-P, and preferably an angle of about 30° to about 60° (see FIG. 4). Thus, the spout receiving portion 92 of the bridge 38 can extend vertically upward along a vertical axis through the assembly (see embodiments 210, 310 discussed hereinbelow) or extend more toward the horizontal. As shown, the spout receiving portion extends outwardly at an angle with respect to plane P-P of the assembly after rotatably positioning the bridge in that position. However, it may be rotated anywhere between the straight up vertical position and the flat horizontal position before assembly.

When assembling the internal water way assembly, standard valve assemblies can thus be used to position vis-à-vis a bridge rotated so as to be in a preferred configuration for a particular design, and a spout tube (which may also include a variety of configurations for design purposes) can be attached. The cover plate is positioned over the assembly and attached thereto. The same bridge configuration and standard valve assemblies can work for a variety of faucet sizes and design configurations while forming only a small number of water way assembly internal faucet components.

Figure 14:
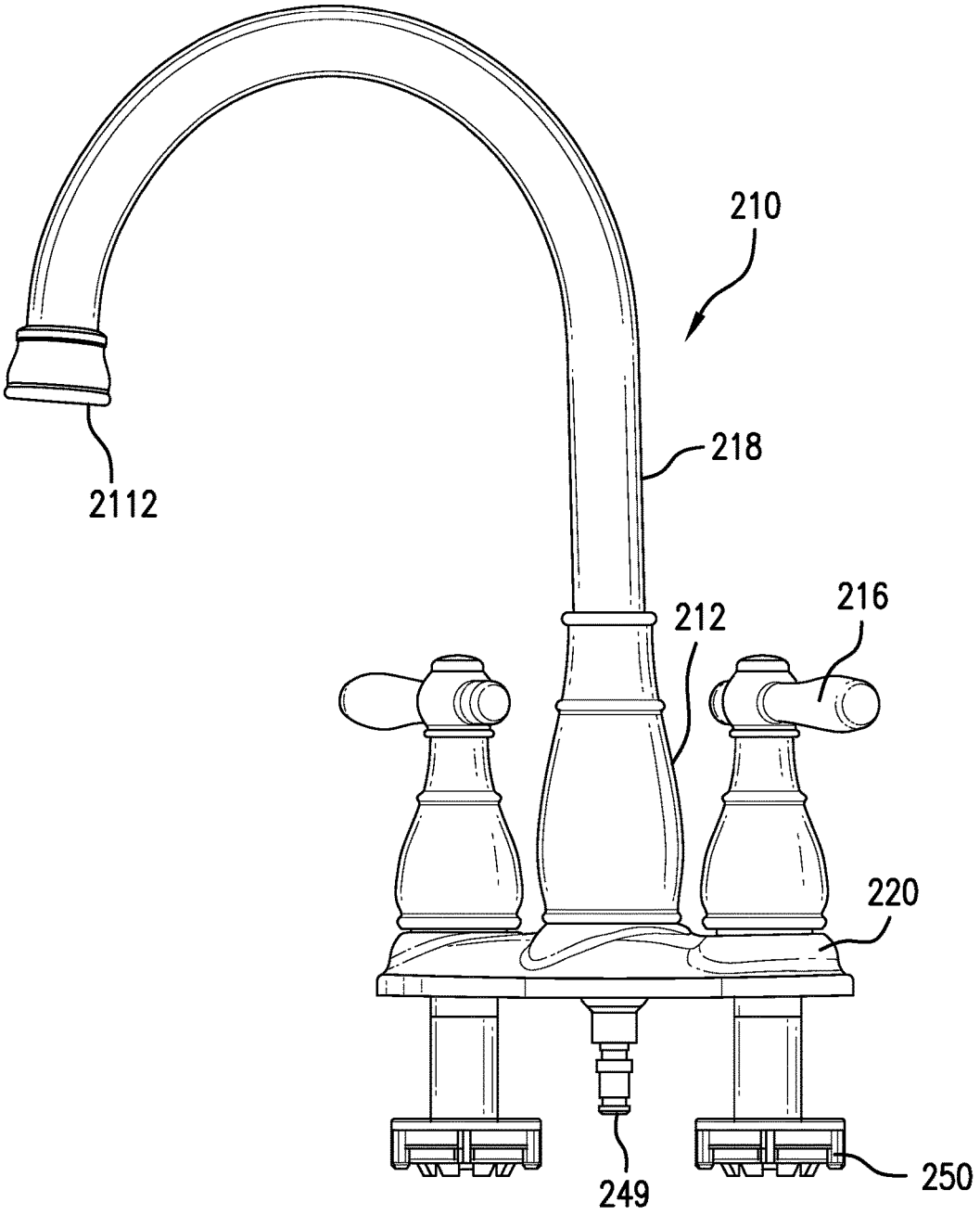
FIG. 14 is a perspective view of an alternative embodiment of a kitchen faucet assembly according to a further embodiment herein.
Figure 15:
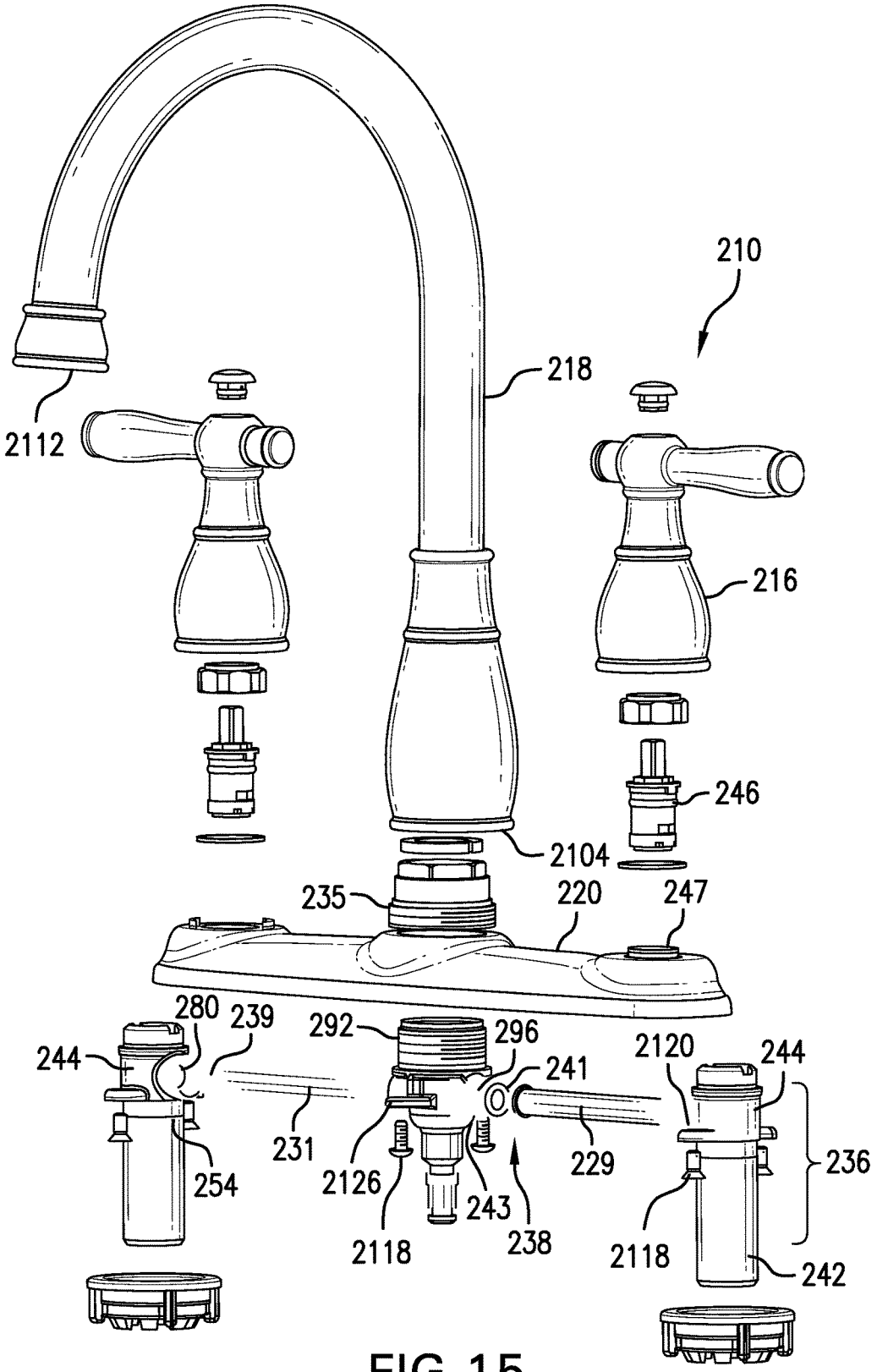
FIG. 15 is an exploded perspective view of the faucet assembly of FIG. 14.
Figure 16:
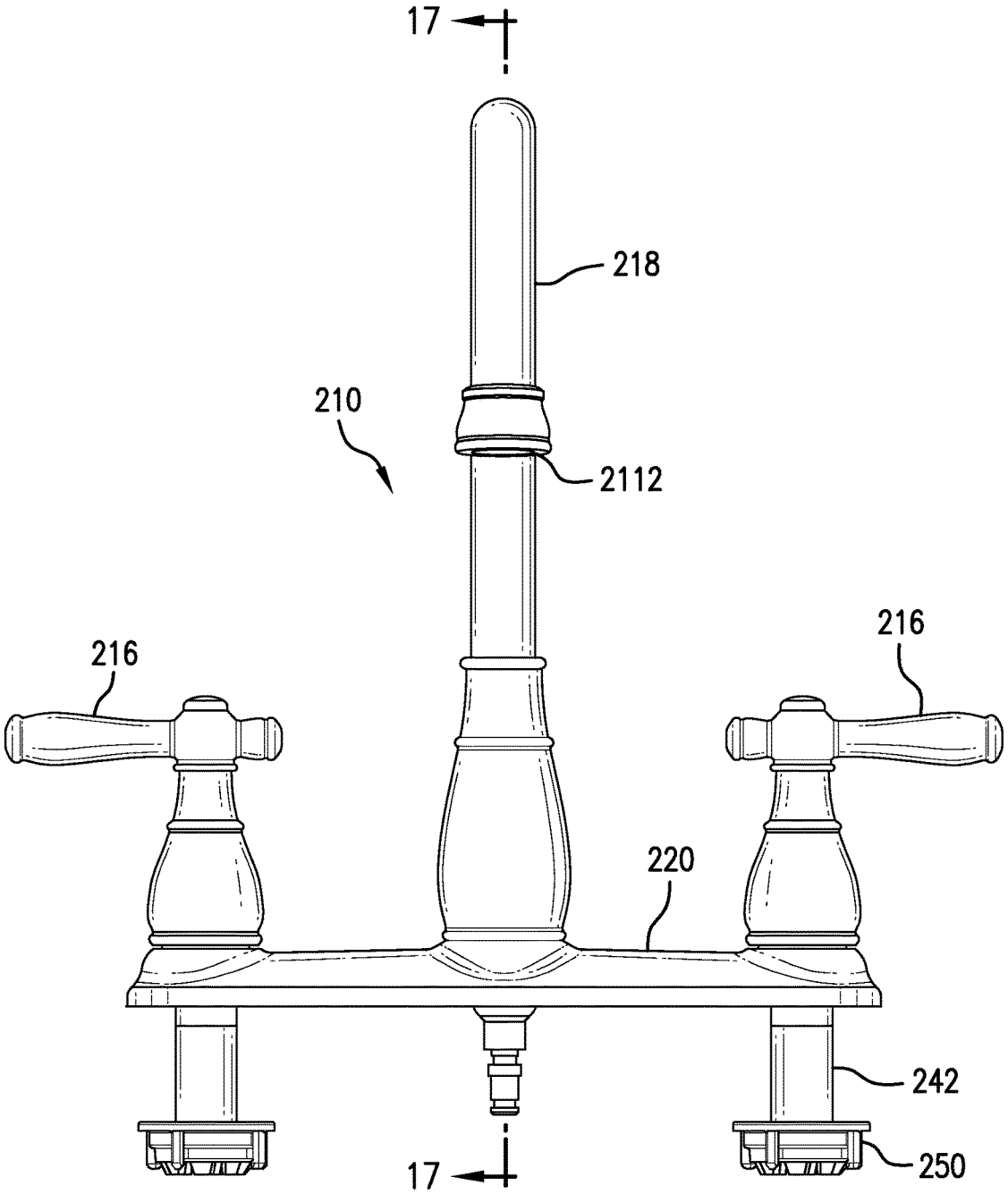
FIG. 16 is a front plan view of the faucet assembly of FIG. 14.
Figure 17:
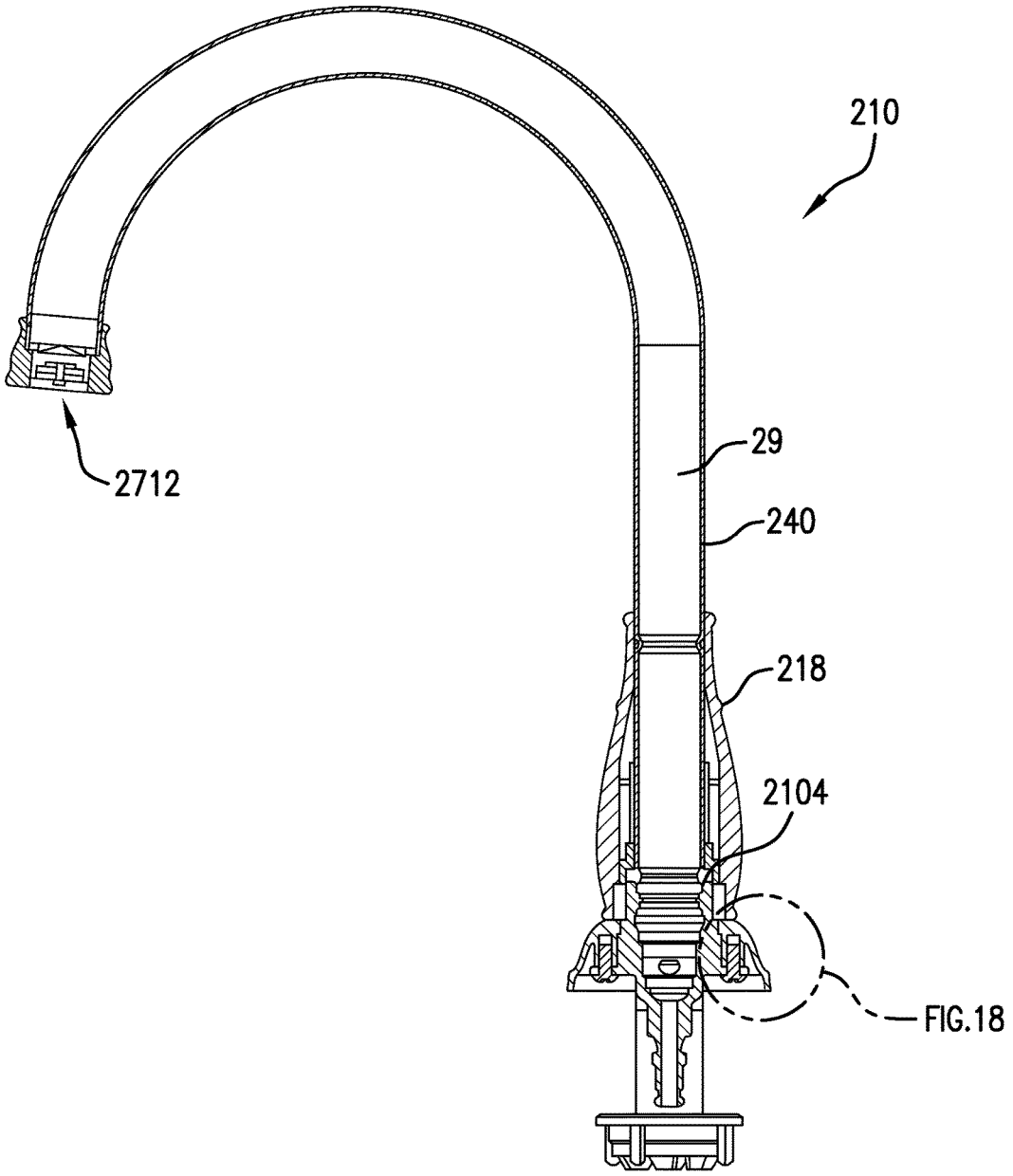
FIG. 17 is a cross-sectional view of the faucet assembly of FIG. 14 taken along line 17-17 of FIG. 16.
Figure 18:
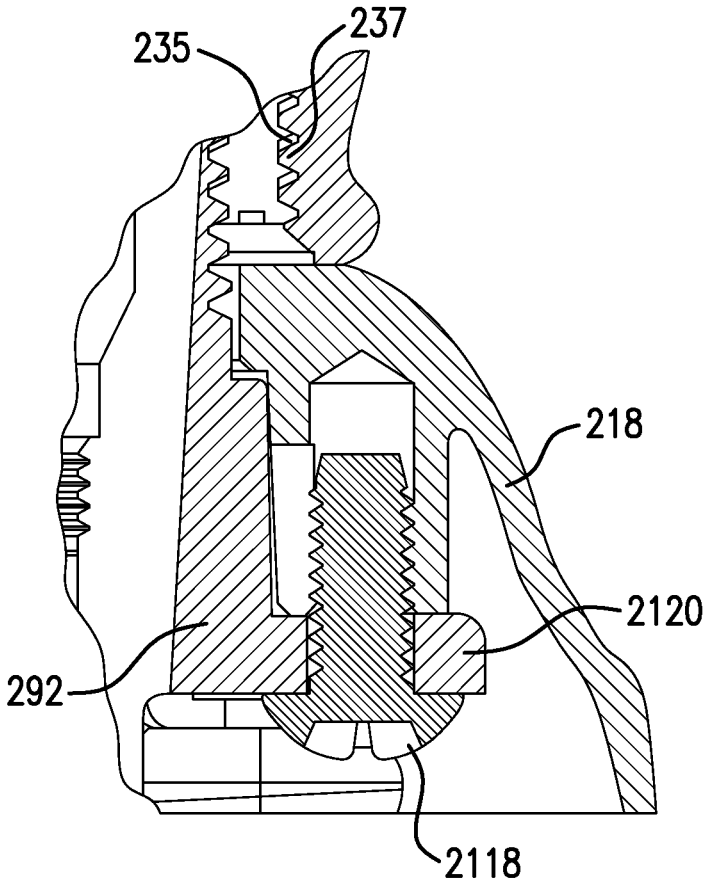
FIG. 18 is an enlarged portion of the faucet assembly taken from FIG. 17.
Figure 19:
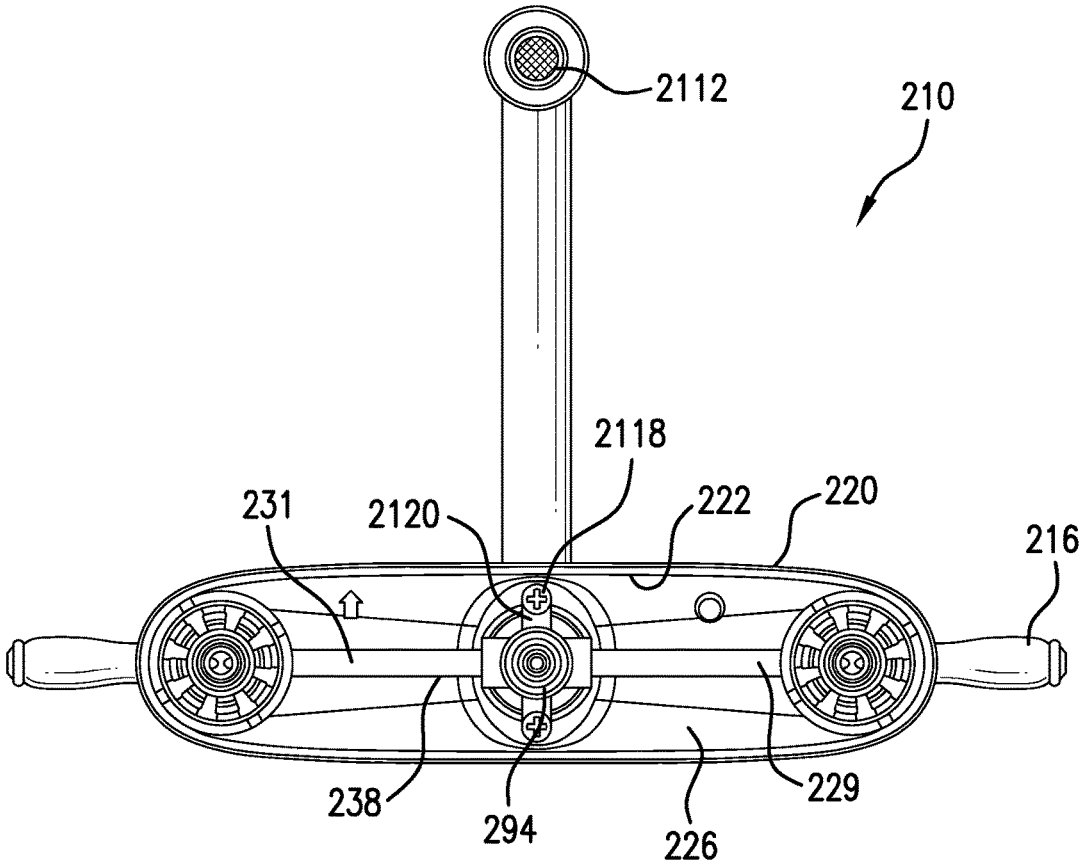
FIG. 19 is a bottom plan view of the faucet assembly of FIG. 14.
Figure 20:
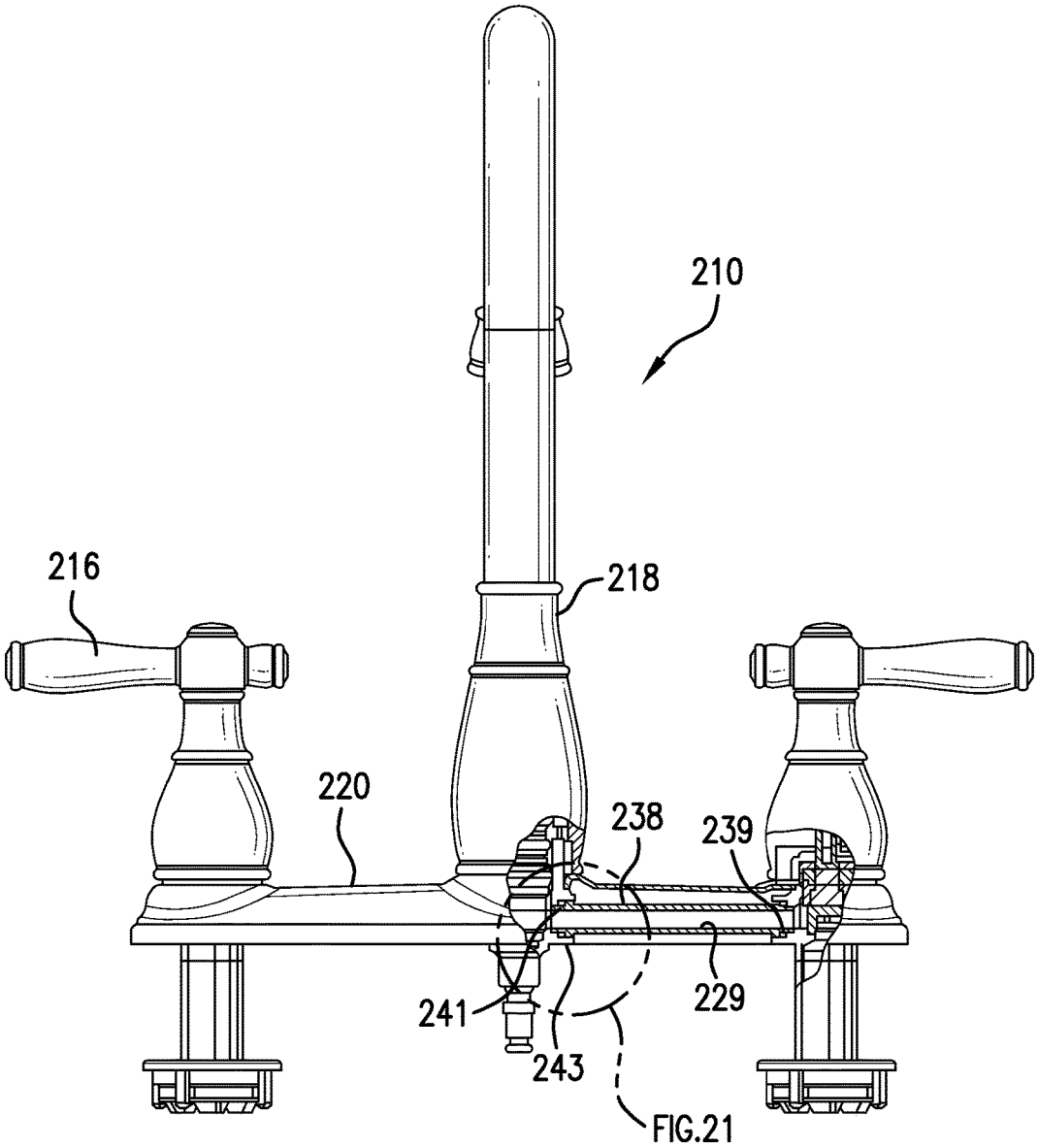
FIG. 20 is a partially broken away rear plan view of the faucet assembly of FIG. 14.
Figure 21:
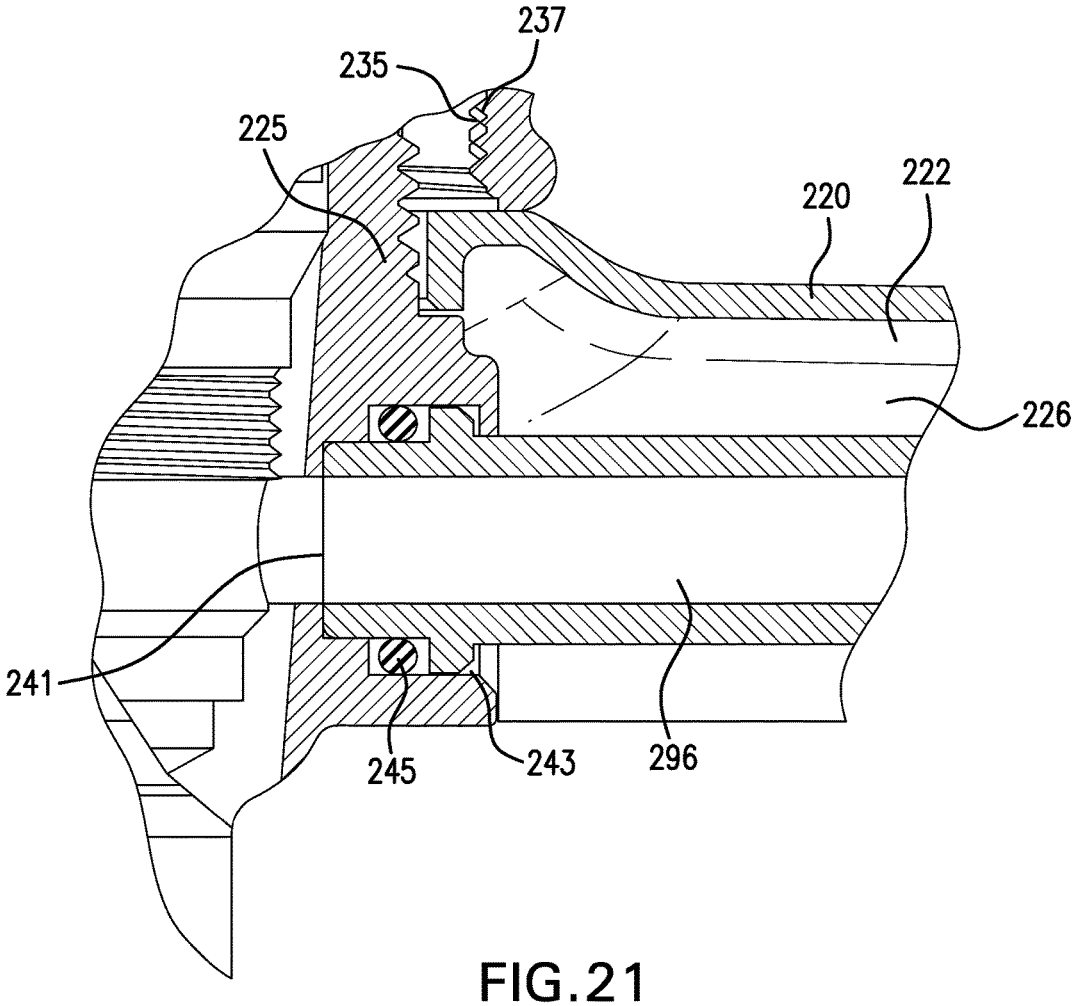
FIG. 21 is an enlarged portion of the faucet assembly taken from FIG. 20.
Figure 22:
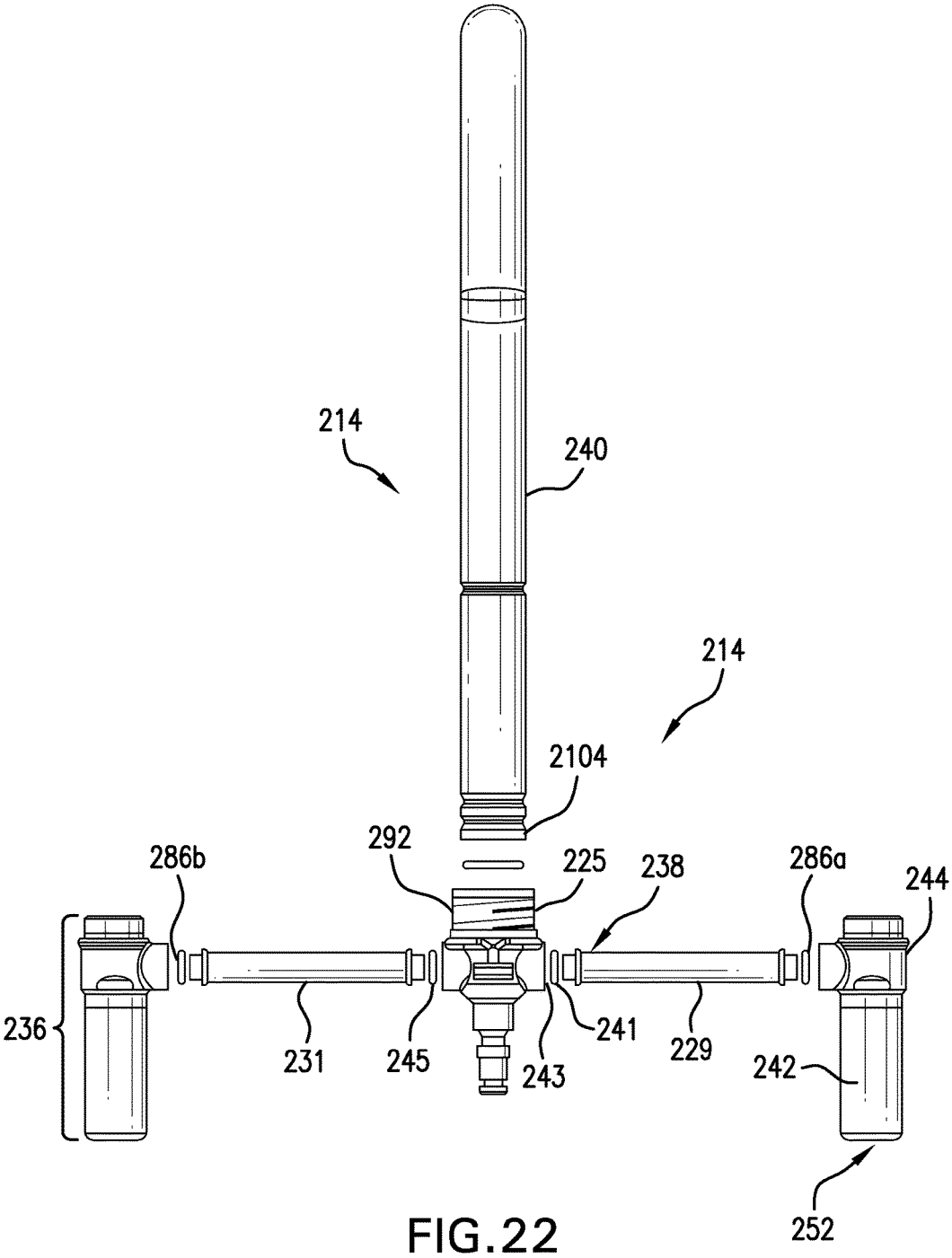
FIG. 22 is a front elevational, exploded view of the water way assembly of the faucet assembly of FIG. 14.
Figure 23:
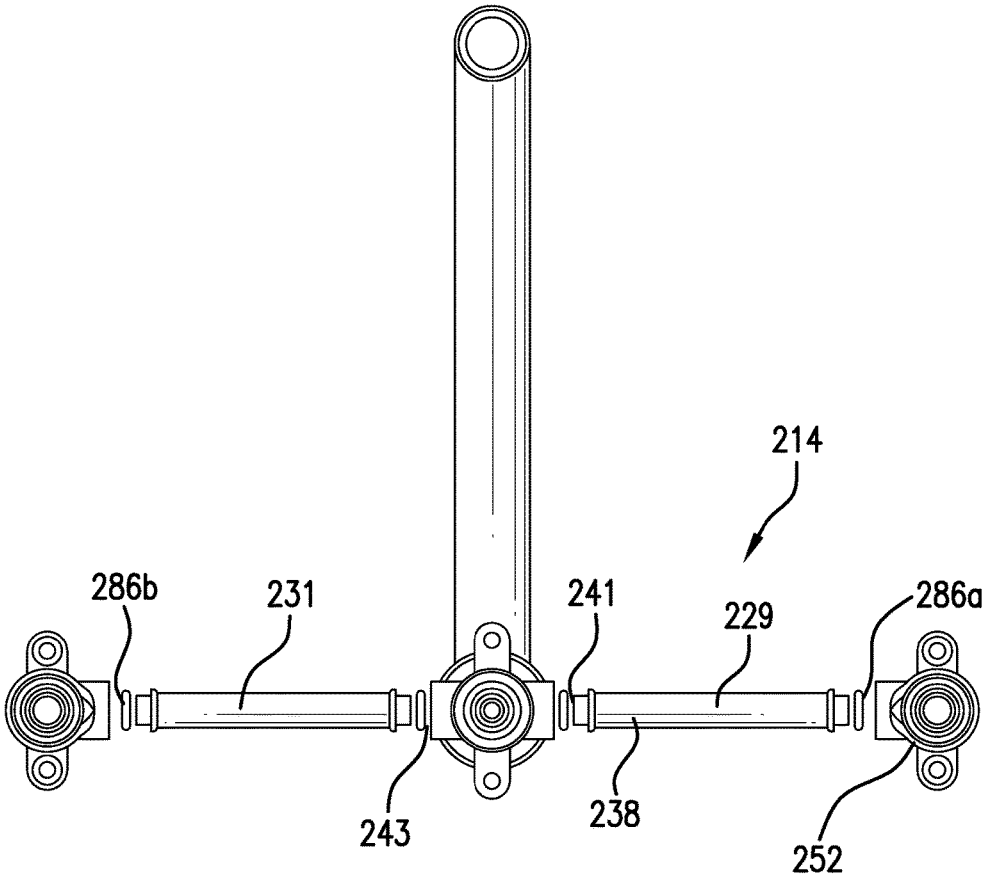
FIG. 23 is an exploded, bottom plan view of the water way assembly of the faucet assembly of FIG. 14.
Figure 24:
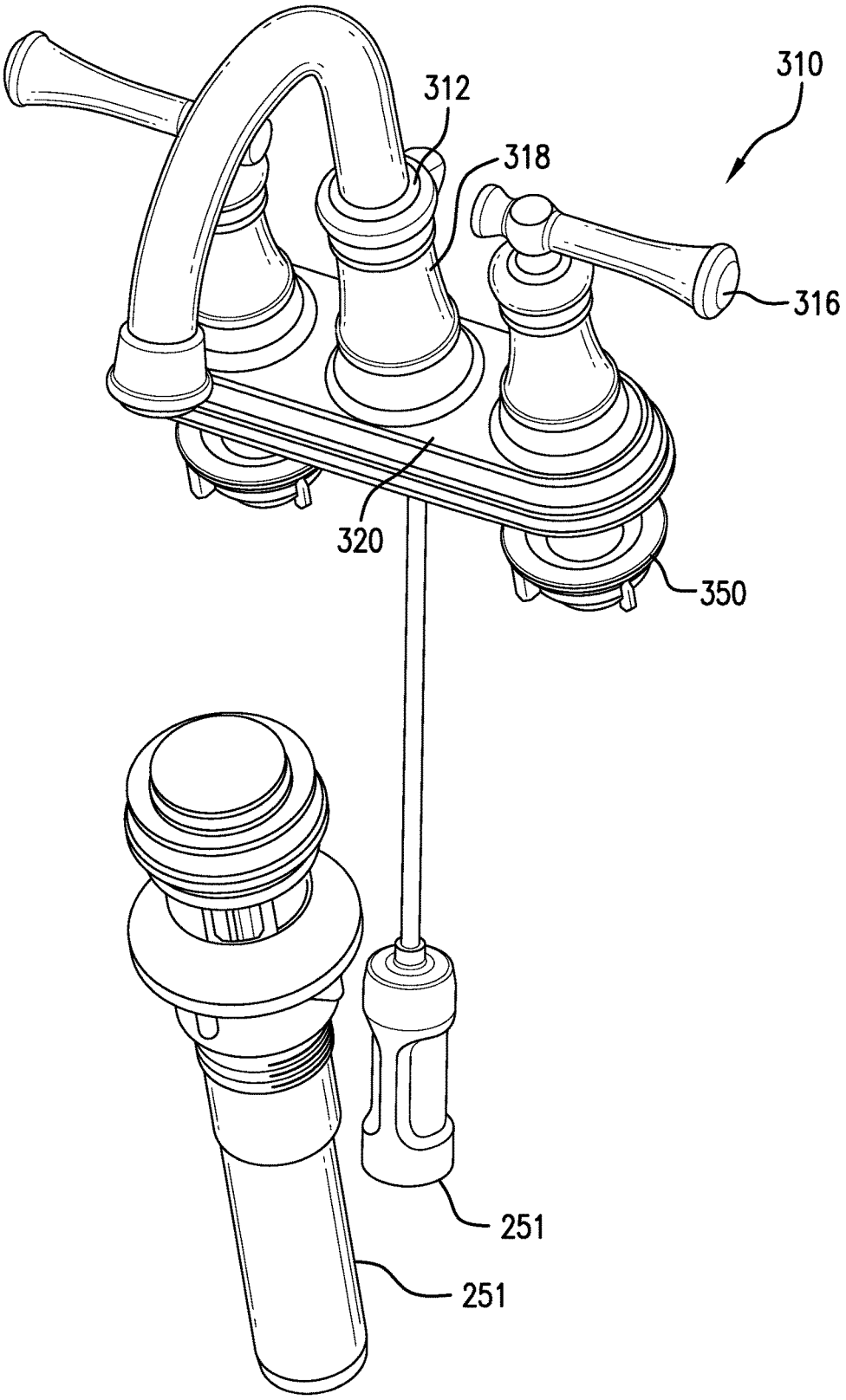
FIG. 24 is a perspective view of a further embodiment of a faucet assembly herein shown in combination with a rapid release drain attachment.
Figure 25:
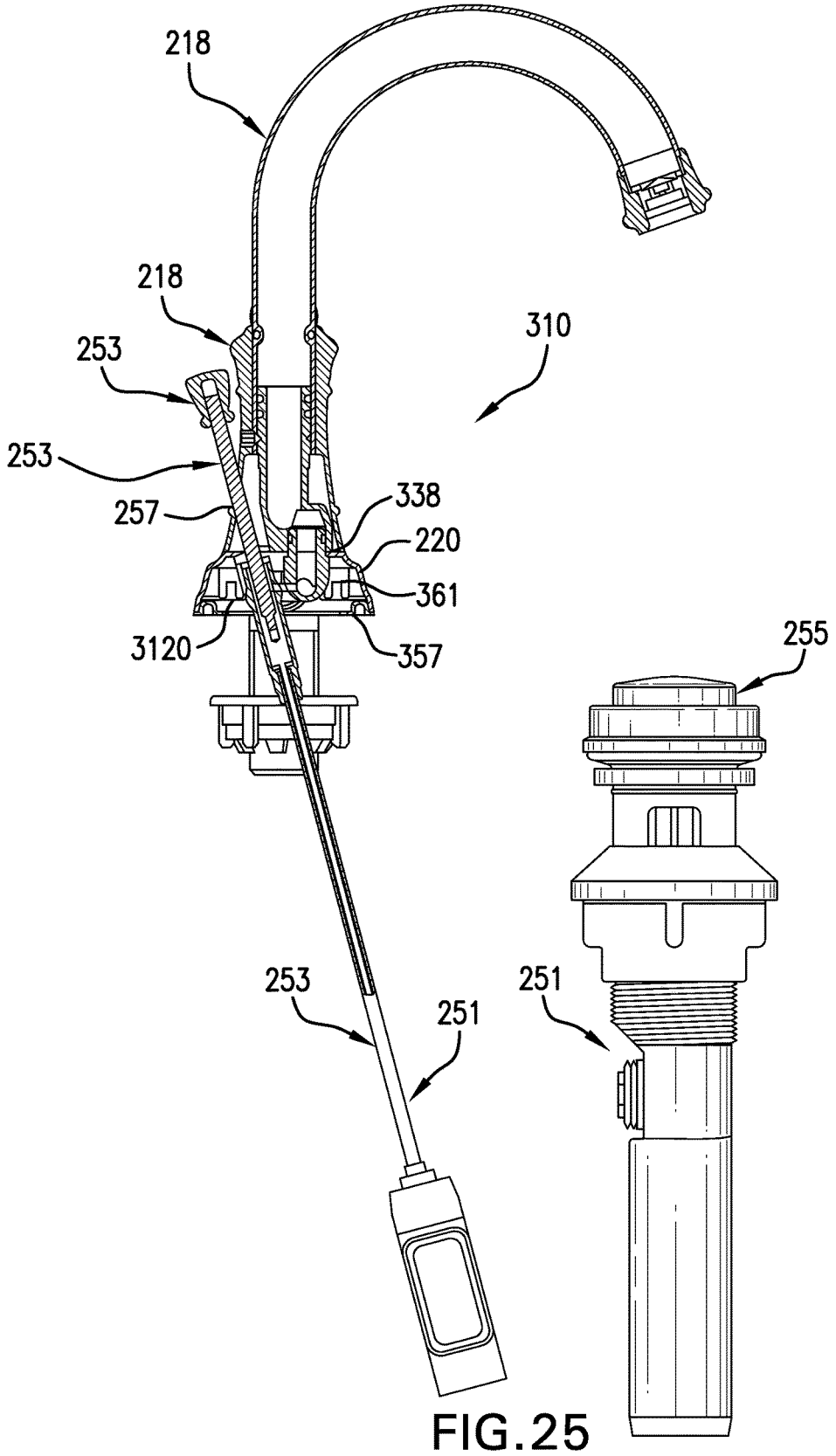
FIG. 25 is a partial cross-sectional view of taken along line 25-25 of FIG. 26.
Figure 26:
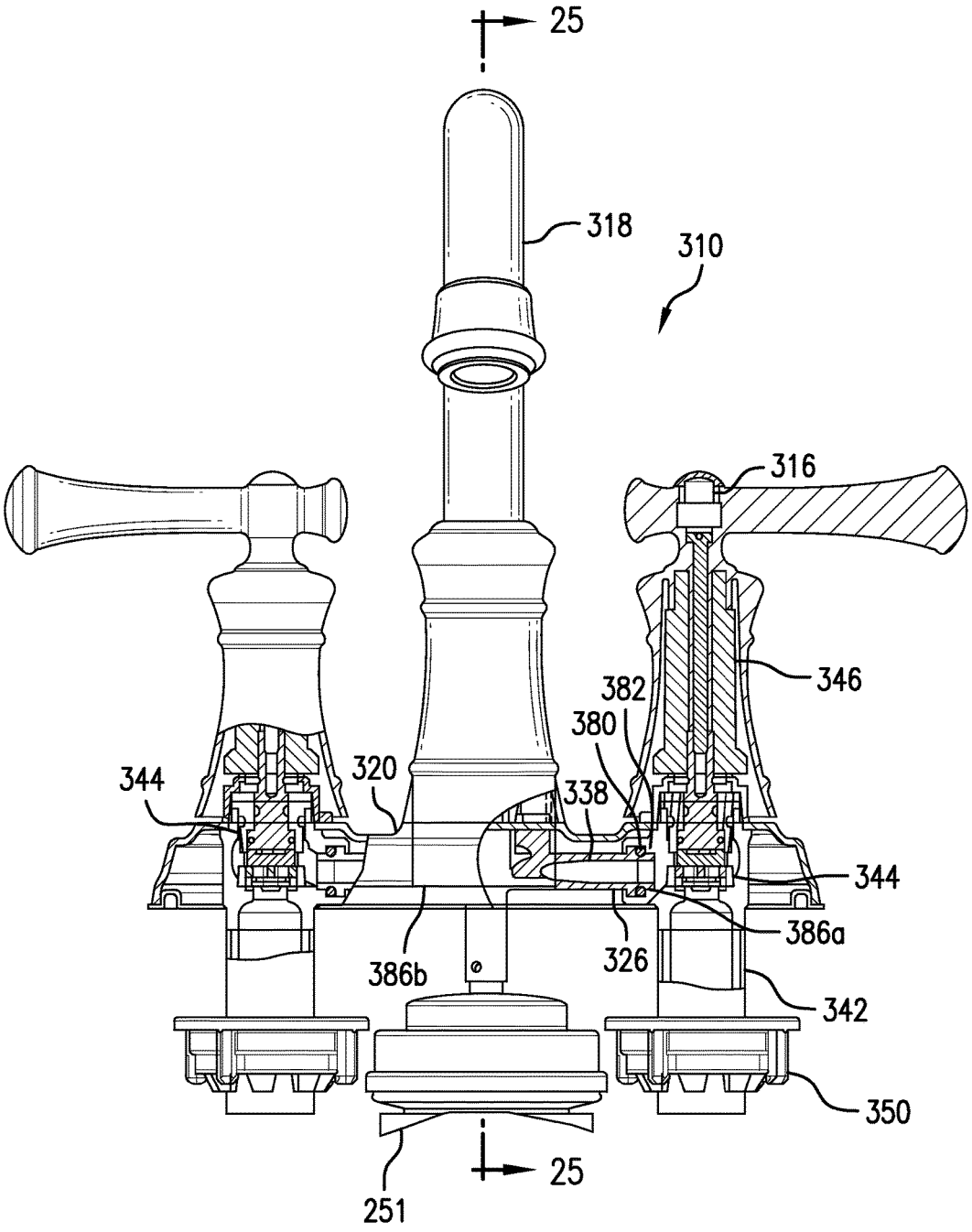
FIG. 26 is a front elevational, partly broken away view of the faucet assembly of FIG. 24.

The spout receiving portion may be molded as a portion of the bridge or in other embodiments of the invention having a multi-part bridge can be a separate intermediate piece. Thus, in such an embodiment, the bridge 38 may have multiple sections. An example is shown in the alternative embodiment of a faucet assembly 210 shown in FIG. 14 as discussed further below. The bridge has a first valve water way section, an intermediate or spout receiving section and a second valve water way section. The intermediate spout receiving section can be rotated with respect to the first and second sections or with respect to the valve water way portion(s) of the valve assembly(ies) or both prior to assembly to position the spout tube.

Also in other embodiments, the spout receiving portion may incorporate an alternative or additional avenue for attaching the cover plate of the faucet assembly to the water way assembly. Taps or other holes may be provided, for example on the front and/or back of the central area of the bridge near the spout receiving portion (or on the spout receiving section of a multi-part bridge) so that fasteners such as self-tapping screws (or other fasteners mentioned herein) can pass through such taps or other holes in the central area or section of the bridge to be seated in mating bores within the cover plate thereby attaching the assembled internal water way to the cover plate via the central area or spout receiving section of the bridge.

By rotating the bridge (either the entire length thereof or a section(s) thereof in a multi-part assembly), the same valve assembly(ies) can act in a modular manner with varying bridges (and bridge sizes) having standard mating ends for the valve assemblies and a variety of spout tube configurations for a modular approach to internal water way assembly design so that the internal water way can be varied to conform and be assembled to work within a wide variety of outer design cover plates for varied faucet assembly products. However, the same valve assemblies can be formed for all of the different faucet designs. Further, standard bridge lengths and/or shapes can be developed so that the valve assembly and bridge combination fit within standard size faucet assembly base configurations.

There is no limit to the size, angle or creative configuration of the spout tube which can be interchanged with more standard sized bridges and valve assemblies. Such modular assembly is very cost effective for manufacture and reduces the number of and need for specialty assemblies while provide variability for creative design within preferred aesthetically pleasing outer cover plates. It also enables the manufacturer to use polymeric molding techniques in forming bridges, spout tubes and/or the valve assemblies or portions thereof which reduces overall cost of the faucet assemblies from those assemblies made primarily of metallic parts.

As noted above, in embodiment 10, the internal water way assembly 14 is attached to the cover plate. The internal water way assembly may be permanently attached by any suitable means such as heat molding, ultrasonic or heat welding, soldering (in the case of metallic parts), use of pressure sensitive and/or heat sensitive adhesive materials and the like. In addition to such permanent bonding or as alternative thereto, the assembly may be releasably attached to the cover plate as shown in the preferred embodiment herein.

As shown, in the embodiment 10 of FIGS. 1-13, the internal water way assembly 14 is releasably attached to the cover plate 12. Optional sealing agents or adhesives (or other bonding techniques noted above may also be used but are not necessary for completing the faucet assembly 10 herein.

Figure 3:
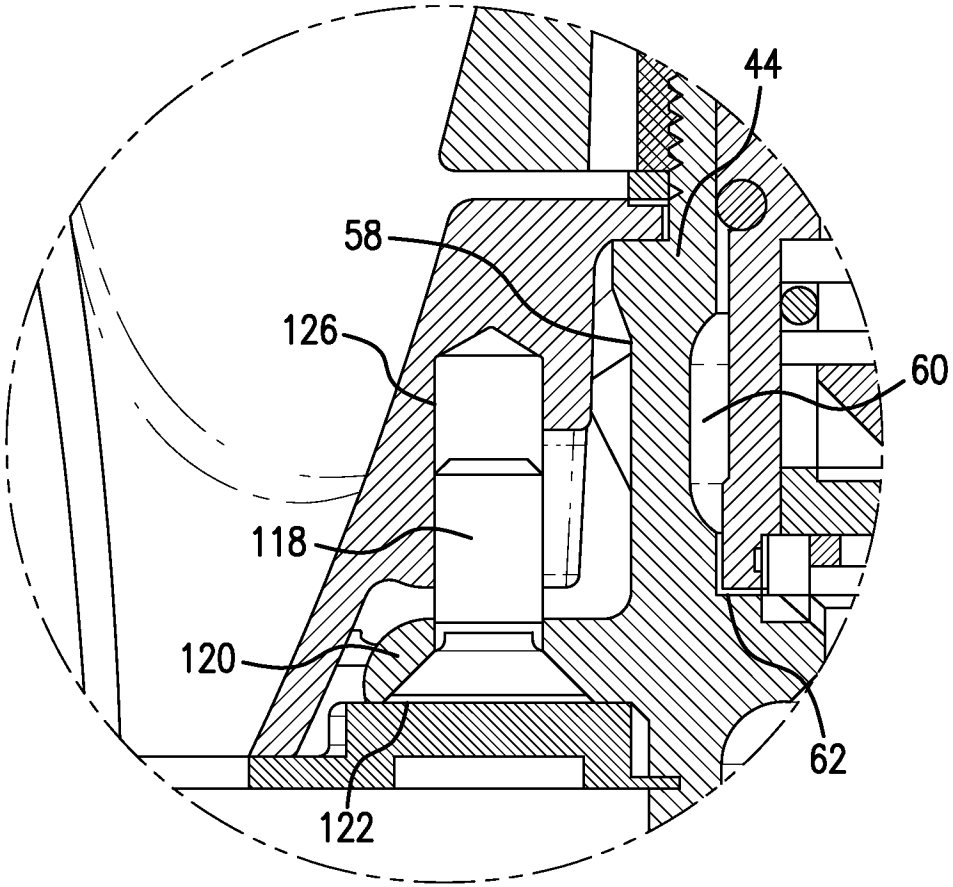
FIG. 3 is an enlarged view of a portion of FIG. 2 showing detail concerning releasable attachment of the internal water way assembly to the cover plate.

In the faucet assembly of FIGS. 1-13, the assembly is releasably attached using fasteners as best shown with reference to FIG. 3. A fastener 118 is positioned within at least one outwardly extending tap 120 on the valve assembly having a hole 122 therein sized to receive the fastener 118. The interior surface 22 of the cover plate 12 on either the top or bottom plate 18, 20 is formed so as to have at least one mating receiving bore 124 to receive the fastener once it passes through the hole 122 in the tap 120. The fastener thus attaches the internal water way assembly 14 to the cover plate 12. Preferably two or more such taps are provided to the valve assembly 36 for a stable and balanced connection and are preferably evenly tightened or snap-fit to the same degree on each portion of the assembly. Two taps are shown in the Figures on each valve assembly such that four fasteners are being used for two valve assemblies and there would be four mating bores on the interior surface of the cover plate. The fasteners 118 may be locking and mating fasteners, or the receiving bore and the fastener may be formed so as that the fastener is a self-tapping screw and the receiving bore is configured to receive the self-tapping screw. In addition, a threaded screw and a bore with mating screw threads may be used. Fasteners 32 are preferably self-tapping screws, however, the fastener(s) and receiving bore(s) may be varied and/or have other interlocking features. Other types of fasteners, including snap fit, dowels, pins, screws, and the like may be used if releasable attachment is desired.

More permanent attachment can also be achieved if desired by using tabs, but preferably without holes and adhering or molding the tabs to the interior surface on a similar piece within the interior surface of the cover plate.

Further, the configurations noted above may be reversed so that the fastener(s) are situated so as to fit into or be part of the cover plate and a screw such as a self-tapping screw may be formed onto the cover plate or received in a recess in the cover plate and the bore(s) may be located on the exterior of the valve water way portions instead of a tap(s) as shown. Finally, it is within the scope of the invention that the cover plate be formed so as to have an interior that snugly receives in features thereof at least the valve water way assembly portion(s) and/or the bridge so that the water way assembly snaps into mating features on the interior surface of the cover plate to hold the water way assembly in place.

Upon assembly and if desired, an optional putty plate 126 as is known in the art may be provided, and formed out of polymeric or metallic materials as noted herein. Such plate is not necessary for structural support and may be used simply for installation purposes as known in the art.

A further embodiment will now be described with respect to embodiment 210 of FIGS. 14-23, wherein analogous components have analogous reference numbers to components in embodiment 10 of FIGS. 1-13. The faucet shown is a kitchen faucet having a two-handle configuration, a multi-part cover plate and a multi-part bridge. Such a faucet may also be a single handle design, but is shown herein as a two-handle design for illustration purposes. In the faucet assembly, the cover plate 212 is a multi-part cover plate having a top spout plate 218 configured to cover a portion or all of a spout tube 240 and a bottom cover plate 220 configured to fit over the valve assembly 236 and bridge 238. The cover plate 212 has an interior surface 222 and an exterior surface 224, wherein the interior surface 222 defines an interior space 226 as shown.

The internal water way assembly 214 includes, as shown includes two valve assemblies 236 each having a shank 242 defining a longitudinally extending interior passageway therein 252, and a valve water way portion 244 positioned on an upper portion 254 of the shank 242 and configured to define a valve seat therein. Such parts may be formed in the same manner and using the same materials as noted above. Valve cartridges 246 for controlling flow through the internal water way assembly 214 are provided, which may be the same as those valve cartridges described above.

The bridge 238 as shown in FIGS. 15, 19-20 and 22-23 is a multi-part bridge having a passageway 296 therethrough in fluid communication with and to receive water from the outlet passageway 280 of the valve water way portion 244 of the valve assembly 236 and the bridge 238 has a spout receiving portion 292 having a passageway 294 therethrough.

The spout tube 240 has an inlet end 2104 configured to be positioned in the spout receiving portion 202 of the bridge 238. The spout tube 240 is open at the inlet end 2104 and in fluid communication with the passageway 296 in the bridge 238. The spout tube 240 has a second outlet end 2112 for delivering water out of the faucet assembly when in use. Two faucet handles 216 are positioned outside interior space 226 and are capable of operably moving the respective valve cartridges 246 for controlling the flow through the internal water way assembly.

As shown, the internal water way assembly 214 is attached to the cover plate 212 via the exemplary self-tapping screw fasteners 2118 on taps 2120 on each of the valve water way portions 244 valve assemblies 236. It is also attached to the cover plate 212 by fasteners 2118, which are shown as threaded screws but could be various types of fasteners as described elsewhere herein, on the spout receiving section 227 of the bridge 238.

The spout receiving section 227 of the bridge 238 is designed so as to be rotatably positioned in an upright position to work with the upwardly positioned spout tube so that the angle γ as described above is 0°. The features on the spout receiving section 227 are accordingly provided to work in such a configuration in terms of attachment to the lower portion 220 of the cover plate 212. The spout receiving portion 292 as shown is also configured to have an outlet portion that has threads 225 for mating with a fitting 233 for attaching the inlet end 2104 of the spout tube 240. The fitting 233 is threaded internally and externally with external threads 235 configured to mate with threads 237 on an interior of a portion of the tube portion of the cover plate 218. Thus, the fitting 233 screws over the top of the threads 225 on the spout receiving portion 292 and the screws 237 of the upper tube cover plate 218 screw onto the external threads 235 of the fitting 233 to tighten the cover plate portions together and the upper cover plate to the spout receiving portion.

While the spout receiving section 227 as shown is configured to be rotatably positioned so that the spout receiving portion 292 is directly upwardly oriented, it is within the scope of the invention that a spout receiving section can be formed that is readily rotated to be positioned at an angle with respect to the faucet plane P-P and the taps 2120 positioned at an alternative location or left off entirely on the spout receiving section.

The components may be configured using the same materials and combinations of materials as noted above with respect to faucet assembly 10. In addition the internal water way 214 may be releasably or permanently attached to the cover plate 212. As shown also in faucet assembly 210, the valve assembly is unitarily formed as a separable component that can be attached permanently or releasably to the bridge 238.

The spout tube 240 may be formed of the materials noted above as well and may have a portion that is cast metallic finish on a molded polymeric material so that the tube may be used directly without a separate outer portion if desired.

The valve cartridges 246 may be the same as those noted above with respect to the faucet assembly 10, and may also extend upwardly through a valve cartridge openings 247 in the bottom cover plate 220 into the faucet handles 216.

The multi-part bridge 238 includes two valve water way sections, a first valve water way section 229 and a second valve water way section 231 each having an inlet in communication with the transversely extending outlet passageways 280 of the valve water way portions 244 of the valve assemblies 236. Each also has an outlet 241. As noted above, a spout receiving section 227 is formed that incorporates the spout receiving portion 292 of the bridge 238. The spout receiving portion also has an inlet 243, and as shown has two such inlets, one for each outlet 241 of each of the valve water way sections 229, 231 of the bridge. When the valve water way sections 229, 231 are assembled with the spout receiving section 227, the bridge passageway 296 extends through the valve water way sections 229, 231 and the spout receiving section 227. The outlets 241 of the valve water way sections 229, 231 of the bridge 238 are each configured to engage the respective inlets 243 of the spout receiving section 227 of the bridge 238. The outlets 241 and inlets 243 may be configured to fit together in mating attachment in a variety of ways as noted above with attachment of the ends 86*a*, 86*b* of the bridge 38 in faucet assembly 10 above. Thus, interlocking pieces, tabs, or, as shown flanges, etc. may be used. Preferably seals such as o-rings 245. The interlocking of the bridge 238 to the valve water way portions 244 and of the valve water way sections 229, 231 to the spout receiving section 227 as well as any sealing engagement may be undertaken as described above with respect to the connection of bridge 38 to bridge receiving portions 82 of the valve water way portions 44 of the embodiment 10 shown in FIGS. 1-15, including but not limited to interlocking mating features, snap-fit features, locking tabs and slots, and bayonet lock connectors.

By preparing a multi-part bridge as shown, even further design standardization for additional automation of manufacture may be achieved in that the valve water way sections 229, 231 can be simply made in standard stock sizes for 4", 8" and other faucet sizes and platforms, while only the spout receiving section 227 is varied in design and/or rotatably positioned as well as variations if desired in spout tube and cover plate design.

While the faucet assembly 210 is shown with two valve assemblies and two valve water way sections on the multi-part bridge, it should be understood that a multi-part bridge can be provided with only a spout receiving section and single valve water way section for a single handle faucet having a hot and/or cold water mixer if desired within the scope of and without departing from the spirit of the present invention.

The spout receiving section 227 of the multi-part bridge 238 of kitchen faucet assembly 210 has an optional feature as shown including a lower outlet attachment feature 249. Such an attachment may be used for attaching a separate fluid connection hose (not shown) for a spray head attachment or a separate hose to a quick-connection fitting for multiple inlet feed of fluid to the faucet assembly. Various quick-connection fittings are known in the art and may be used with the invention. One preferred embodiment of a quick-connection fitting is described and enclosed in U.S. Pat. No. 9,376,789 B2, incorporated herein by reference.

The invention also includes an embodiment as shown herein in the form of a lavatory faucet assembly 310. The faucet assembly 310 has a bridge 338 which is not a multi-part bridge. The faucet assembly 310 is shown with a rapid installation drain assembly 351. The drain assembly may be any suitable drain assembly, and such assemblies may be used with various embodiments of faucet assemblies herein. As shown, a drain assembly such as that described in U.S. Pat. No. 7,886,372 is used. The relevant portions of that patent are incorporated herein by reference to explain the manner in which such a drain assembly is made and used. A drain actuator and motion translation device are attached as assembly 253 to a recess 257 in the cover plate 312. A drain assembly 255 connects to the assembly 253 when fully assembled and installed in and beneath a sink basin.

Figure 27:
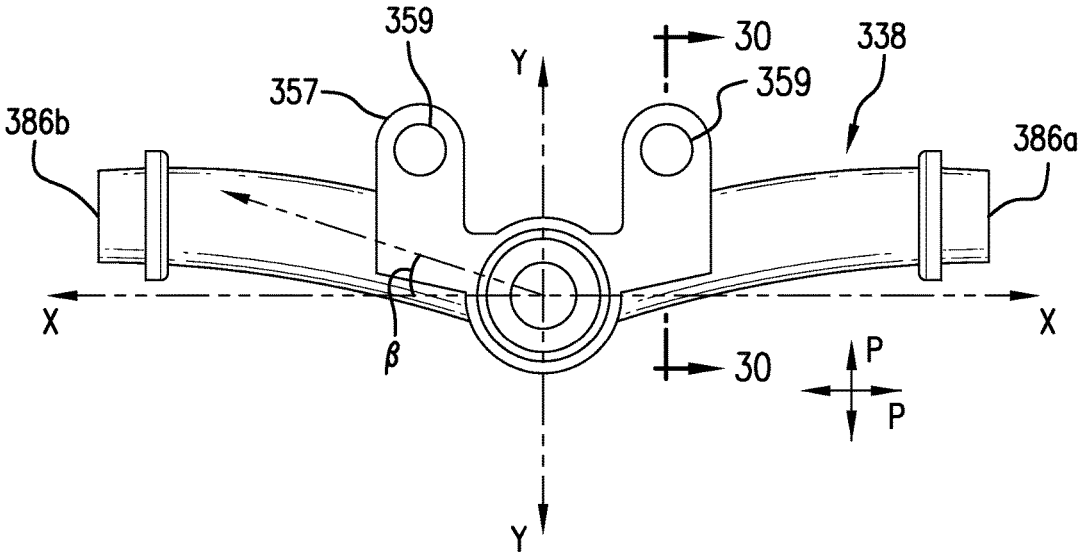
FIG. 27 is a top elevational view of a bridge of the faucet assembly of FIG. 24.
Figure 28:
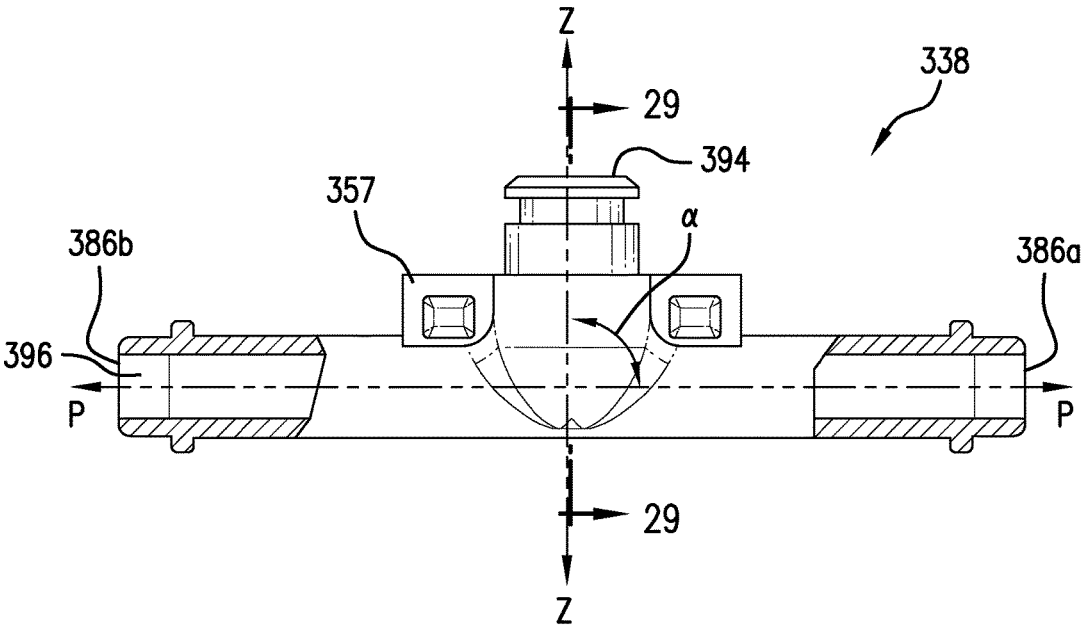
FIG. 28 is a partly broken away front elevational view of the bridge of FIG. 27.
Figure 29:
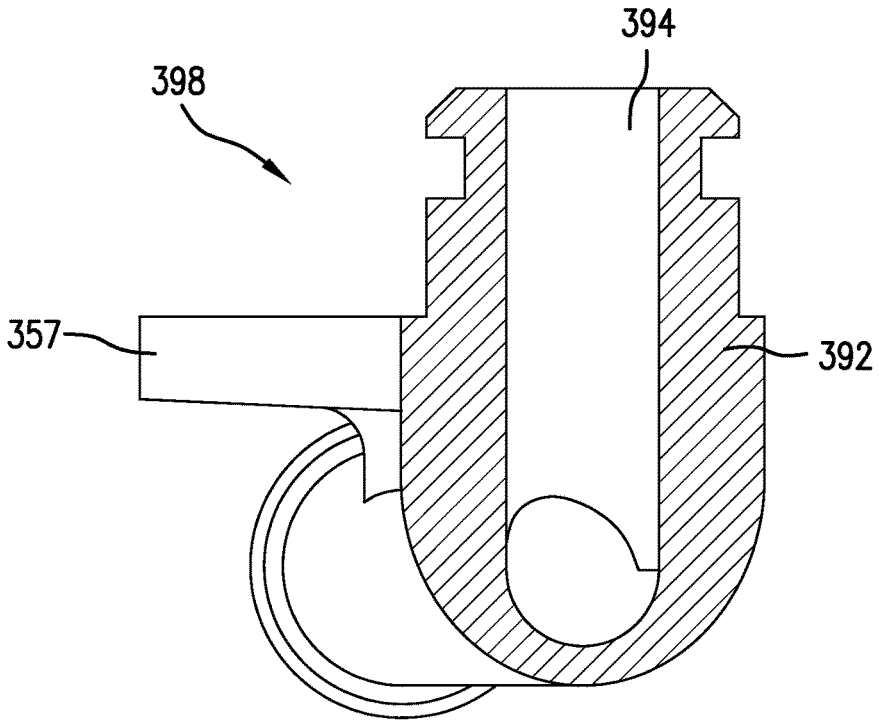
FIG. 29 is cross-sectional view of the bridge of FIG. 27 taken along line 29-29 of FIG. 28.
Figure 30:
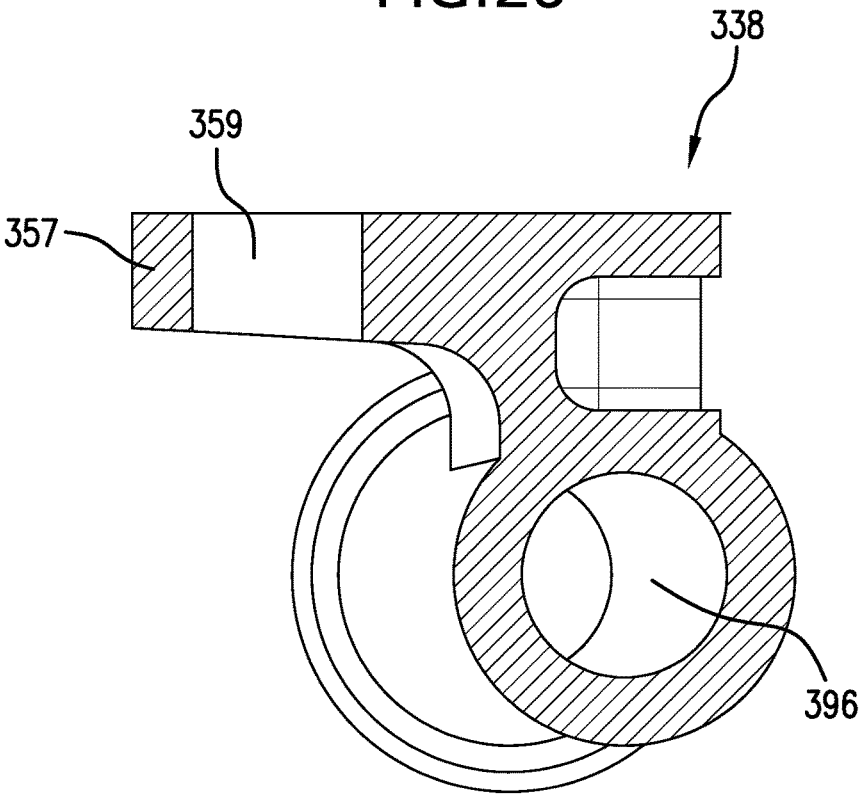
FIG. 30 is a cross-sectional view of the bridge of FIG. 27 taken along line 30-30 of FIG. 27.

The bridge has inlet ends 386*a*, 386*b* and a passageway 396 therethrough so that flow through the passageway meets in the spout receiving portion 394 and passes upwardly through passageway 394 of the spout receiving portion. The bridge, as shown in FIGS. 27 and 28 is angled in the x-y plane P-P between the x-x axis and the y-y axis at an angle β so as to create a slightly bent and curved backward angled bridge. The spout receiving portion 394 is at a 90° angle α between plane P-P and the z-axis.

Further, a flange 357 having fastener holes 359 therein is provided as an attachment to or formed with the spout receiving portion 392 of the bridge 338. Fasteners can be provided to attach the flange and spout receiving portion to the cover plate. Further fasteners 357 may be provided through taps 3120 as well if desired for further attachment between the valve water way portions 344 and the cover plate in the manner described above with respect to embodiments 10 and 210. The valve cartridges 346 may also be configured in a somewhat different manner than those of embodiments 10 and 210 to work with and fit within decorative handles 316.

In all other respects, the faucet assembly 310 functions like the embodiment 10 and analogous features and reference numbers herein refer to analogous parts.

The invention also includes a method of assembling a faucet having an internal water way and will be described with respect to embodiment 10 of FIGS. 1-15. The method includes providing a cover plate 12 having an interior surface 22 defining an interior space 26. Such cover plates may be as described above with respect to the various embodiments as well. An internal water way 14 is assembled. The water way preferably has at least one component comprising a polymeric material. The internal water way 14 is assembled by forming a valve assembly 36, or in the case of a two-handle faucet, two valve assemblies 36, each comprising a shank 42 defining a longitudinally extending interior passageway 52 therein. The valve assembly(ies) also include a valve water way portion 44 positioned on an upper portion 54 of the shank 52 and is configured to define a valve seat 62 therein. The valve water way portion(s) 44 each have a transversely extending outlet passageway 80 therein. The valve seat(s) 62 are configured to receive fluid from a fluid source, A valve cartridge 46 is positioned in each valve seat 62. The valve cartridges are for controlling flow and may be as described elsewhere herein. The cartridges have an inlet 76 for receiving water entering the valve seat 62 and an outlet 78 in communication with the outlet passageway 80 of the valve water way portion 44.

A bridge 38 is provided according to the various embodiments herein and has a passageway 96 therethrough and a spout receiving portion 92 having a passageway 96 therethrough.

The bridge is rotatably positioned such that the spout receiving portion 92 is aligned to receive a spout tube 40 and the spout tube 40, bridge 38 and valve assembly 36 will fit within the interior space of the cover plate upon assembly.

The bridge 38 is also attached to the valve water way portion 44 so that the passageway within the bridge 96 is in fluid communication with and able to receive water from the outlet passageway 80 of the valve water way portion 44 of the valve assembly 36. The bridge may be attached and if not permanently attached rotated into position. Alternatively, the bridge is rotated to the desired position and then the valve water way portions attached thereto. If a multi-part bridge as in embodiment 210 is used, the spout receiving section is rotated to position and the bridge assembled by attaching the valve water way sections of the bridge and then attaching the valve water way portions to the valve water sections of the bridge. Alternatively, the valve water way sections can first be attached to the valve assembly valve water way portions and then the spout receiving section positioned and attached to the valve water way sections of the bridge.

The inlet end 104 of a spout tube 40 is attached to the spout receiving portion 92 of the bridge 38 to form an assembled internal water way. If a multi-part bridge is used, the spout receiving portion may be attached prior to completion of the bridge assembly if desired. Once assembled, the spout tube 40 is open at the inlet end 104 so as to be in fluid communication with the passageway 96 in the bridge 38 upon attachment and the spout tube 40 has a second outlet end 112 for delivering water out of the faucet assembly when in use.

The cover plate 12 is positioned over the assembled internal water way 14 and the interior surface 22 of the cover plate 12 is attached to the assembled internal water way 14. The cover plate may be attached using a variety of fastener or interlocking techniques as noted above on either a spout receiving section on a multi-part bridge assembly, an area of the bridge near the spout receiving portion on a single part bridge or on one or more taps or similar structures on the valve water way portions of the valve assemblies as described herein above.

The faucet handle(s) 16 are then positioned on the valve cartridge(s) 46 so that the handle(s) is capable of operably moving the valve cartridge(s) 46 for controlling the flow through the assembled internal water way.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A faucet assembly, comprising (a) a cover plate having an interior surface and an exterior surface; and (b) an internal water way assembly, comprising (i) a valve assembly having a shank defining a longitudinally extending interior passageway therein, and a valve water way portion positioned on an upper portion of the shank and configured to define a valve seat therein, wherein the valve water way portion has a transversely extending outlet passageway therein, and the valve seat is configured to receive fluid from a fluid source, and (ii) a valve cartridge for controlling flow through the internal water way assembly having an inlet for receiving water entering the valve seat and an outlet in communication with the outlet passageway of the valve water way portion;

(iii) a bridge having a passageway therethrough in fluid communication with and to receive water from the outlet passageway of the valve water way portion of the valve assembly and the bridge having a spout receiving portion having a passageway therethrough; and (iv) a spout tube having an inlet end configured to be positioned in the spout receiving portion of the bridge, the spout tube open at the inlet end and in fluid communication with the passageway in the bridge and having a second outlet end for delivering water out of the faucet assembly when in use;

(c) at least one faucet handle positioned outside an interior space defined by the interior surface of the cover plate and capable of operably moving the valve cartridge for controlling the flow through the internal water way assembly, and (d) a putty plate, wherein the internal water way assembly is directly attached to the cover plate, the bridge is a separate component that is configured to be fully assembled to the valve faucet assembly in any one of a plurality of fixed angular orientations with respect to the valve assembly to position the spout tube to fit within an interior space defined by the interior surface of the cover plate and for a variety of cover plates, the cover plate comprises a top cover plate configured to cover the internal water way assembly and to be positioned on an upper surface portion of the spout tube, and a bottom cover plate configured to cover a bottom surface portion of the spout tube, wherein the top and the bottom cover plates are configured to be locked together, and wherein the bottom cover plate is distinct from the putty plate, and at least one component in the internal water way assembly comprises a polymeric material.

2. The faucet assembly of claim 1, wherein the internal water way assembly is releasably attached to the cover plate.

3. The faucet assembly of claim 1, wherein the valve assembly has at least one outwardly extending tap with a hole therein for receiving a fastener and the interior surface of the cover plate has at least one receiving bore for receiving the fastener such that the internal water way assembly is releasably attached to the interior surface of the cover plate by the fastener.

4. The faucet assembly of claim 3, wherein the fastener is a self-tapping screw and the at least one receiving bore receives the self-tapping screw.

5. The faucet assembly of claim 3, wherein the valve assembly has two of the outwardly extending taps, each with the hole therein and the interior surface of the cover plate has two of the receiving bores.

6. The faucet assembly of claim 1, wherein there are two valve assemblies each located on an opposite end of the bridge.

7. The faucet assembly of claim 6, wherein each of the valve assemblies has at least one outwardly extending tap with a hole therein for receiving a fastener and the interior surface of the cover plate has at least two receiving bores for receiving a fastener such that the internal water way assembly is releasably attached to the interior surface of the cover plate by at least two fasteners.

8. The faucet assembly of claim 7, wherein the fasteners are self-tapping screws and the receiving bores receive the screws.

9. The faucet assembly of claim 7, wherein each of the valve assemblies has two of the at least one outwardly extending taps, and the interior surface of the cover plate has four of the at least two receiving bores.

10. The faucet assembly of claim 1, wherein the shank, the valve water way portion, the bridge and the spout tube each comprise a polymeric material.

11. The faucet assembly of claim 1, wherein the valve water way portion and the shank are unitarily formed.

12. The faucet assembly of claim 1, wherein the shank comprises a metallic material and the valve water way portion, the bridge and the spout tube all comprise a polymeric material.

13. The faucet assembly of claim 1, wherein the shank, the valve water way portion and the bridge all comprise a metallic material and the spout tube comprises a polymeric material.

14. The faucet assembly of claim 1, wherein the shank comprises a metallic material and a polymeric material and the valve water way portion, the bridge and the spout tube all comprise a polymeric material.

15. The faucet assembly of claim 1, wherein the valve water way portion has a bridge receiving portion and the transversely extending outlet passageway of the valve water way portion passes at least partially through the bridge receiving portion, the bridge receiving portion is open at one end, the bridge has an open inlet end in communication with the passageway through the bridge and the transversely extending outlet passageway of the valve water way portion, and the inlet end of the bridge being configured to engage the bridge receiving portion of the valve water way portion, such that the valve assembly is releasably attachable to the bridge, and the shank and the valve water way portion are a separable assembly.

16. The faucet assembly of claim 15, wherein the bridge receiving portion of the valve water way portion of the valve assembly sealingly engages the inlet end of the bridge.

17. The faucet assembly of claim 16, wherein the spout tube is flexible so as to be manipulated to fit within the interior space and/or is pre-formed to have a shape to fit within the interior space.

18. The faucet assembly of claim 15, wherein a second valve assembly is positioned on an opposite end of the bridge from the valve assembly, wherein the second valve assembly has a second valve water way portion having a bridge receiving portion and a second transversely extending outlet passageway extending partially therethrough, and wherein the bridge has a second inlet opening on an opposite end from the open inlet end, the second inlet opening also being in communication with the passageway through the bridge and with the second transversely extending outlet passageway of the second valve water way portion of the second valve assembly, wherein the second inlet opening of the bridge is configured to engage the second bridge receiving portion of the second valve water way portion, such that the second valve assembly is releasably attachable to the bridge, and such that a second shank of the second valve assembly and the second valve water way portion form a separable assembly.

19. The faucet assembly of claim 1, wherein the valve water way portion has a bridge receiving portion and the transversely extending outlet passageway of the valve water way portion passes at least partially through the bridge receiving portion, the bridge receiving portion is open at one end, the bridge has an open inlet end in communication with the passageway through the bridge and the transversely extending outlet passageway of the valve water way portion, and the inlet end of the bridge is configured to engage the bridge receiving portion of the valve water way portion, wherein the shank and the valve water way portion are a separable assembly from the bridge for rotatable positioning of the bridge prior to assembly, and upon assembly, the valve assembly is permanently attached to the bridge.

20. The faucet assembly of claim 1, wherein the top cover plate has a female receiving bore and the bottom cover plate has a male connecting pin for snap fitting the top and bottom cover plates together.

21. The faucet assembly of claim 1, wherein the cover plate is a multi-part cover plate and has a top spout plate configured to cover the spout tube and a bottom plate configured to fit over the valve assembly and the bridge.

22. The faucet assembly of claim 1, further comprising a nut to tighten the faucet assembly against a mounting plate.

23. The faucet assembly of claim 1, wherein the valve cartridge extends upwardly through a valve cartridge opening in the cover plate into an interior space within the faucet handle.

24. The faucet assembly of claim 1, wherein the spout receiving portion of the bridge comprises an outwardly extending flange having receiving holes therein for receiving a fastener, and the cover plate further comprises a receiving bore such that a fastener may be used to attach the spout receiving portion to the cover plate.

25. The faucet assembly of claim 1, wherein the bridge is a multi-part bridge and comprises a valve water way section having an inlet in communication with the transversely extending outlet passageway of the valve water way portion of the valve assembly, and an outlet, and a spout receiving section comprising the spout receiving portion of the bridge and having an inlet, wherein the bridge passageway extends through the valve water way section and the spout receiving section when the valve water way section and spout receiving section are assembled, and the outlet of the valve water way section of the bridge is configured to engage the inlet of the spout receiving section of the bridge.

26. The faucet assembly of claim 25, further comprising a second valve assembly, and the bridge further comprises a second valve water way section having an inlet in communication with a transversely extending outlet passageway of a valve water way portion of the second valve assembly, and an outlet, wherein the spout receiving section comprises a second inlet, the bridge passageway further extends through the second valve water way section when the valve water way section, the spout receiving section and the second valve water way section are assembled, and the outlet of the second valve water way section is configured to engage the second inlet of the spout receiving section.

27. A faucet assembly, comprising (a) a cover plate having an interior surface and an exterior surface; and (b) an internal water way assembly, comprising (i) a first valve assembly and a second valve assembly, each of the first valve assembly and the second valve assembly having a shank defining a longitudinally extending interior passageway therein, and a valve water way portion positioned on an upper portion of the shank and configured to define a valve seat therein, wherein the valve water way portion has bridge receiving portion having a transversely extending outlet passageway therein, and the valve seat is configured to receive fluid from a fluid source;

(ii) a first valve cartridge and a second valve cartridge, each for controlling flow through the internal water way assembly and each having an inlet for receiving water entering the respective valve seat of the first and the second valve assemblies and an outlet in communication with the respective outlet passageway of the bridge receiving portion of the valve water way portion of the first and the second valve assemblies;

(iii) a bridge having a passageway therethrough and a first and a second open inlet end, the first open inlet end configured to fit within the bridge receiving portion of the valve water way portion of the first valve assembly so as to receive water from and be in fluid communication with the outlet passageway of the bridge receiving portion of the valve water way portion of the first valve assembly, the second open inlet end configured to fit within the bridge receiving portion of the valve water way portion of the second valve assembly so as to receive water from and be in fluid communication with the outlet passageway of the bridge receiving portion of the valve water way portion of the second valve assembly, and the bridge having a spout receiving portion having a passageway therethrough; and (iv) a spout tube having an inlet end configured to be positioned in the spout receiving portion of the bridge, the spout tube open at the inlet end and in fluid communication with the passageway in the bridge and having a second outlet end for delivering water out of the faucet assembly when in use;

(c) a first and a second valve handle each being capable of operably moving the first and the second valve cartridges respectively for controlling the flow of water through the internal water way assembly, and (d) a putty plate, wherein the internal water way assembly is attached directly to the cover plate, the bridge is a separate component that is configured to be fully assembled to the faucet assembly in any one of a plurality of fixed angular orientations with respect to the valve assemblies to position the spout tube to fit within an interior space defined by the interior surface of the cover plate and for a variety of cover plates, the cover plate comprises a top cover plate configured to cover the internal water way assembly and to be positioned on an upper surface portion of the spout tube, and a bottom cover plate configured to cover a bottom surface portion of the spout tube, wherein the top and the bottom cover plates are configured to be locked together, and wherein the bottom cover plate is distinct from the putty plate, and at least one component in the internal water way assembly comprises a polymeric material.

28. The faucet assembly of claim 27, wherein the internal water way assembly is releasably attached to the cover plate.

29. The faucet assembly of claim 27, wherein each of the shanks, each of the valve water way portions, the bridge and the spout tube comprise a polymeric material.

30. The faucet assembly of claim 27, wherein the first valve water way portion and the first shank are unitarily formed and the second valve water way portion and the second shank are unitarily formed.

31. The faucet assembly of claim 27, wherein each of the shanks comprises a metallic material and the each of the valve water way portions, the bridge and the spout tube comprise a polymeric material.

32. The faucet assembly of claim 27, wherein each of the shanks, each of the valve water way portions and the bridge comprise a metallic material and the spout tube comprises a polymeric material.

33. The faucet assembly of claim 27, wherein each of the shanks comprises a metallic material and a polymeric material and the valve water way portions, the bridge and the spout tube all comprise a polymeric material.

34. The faucet assembly of claim 27, wherein the bridge comprises a first valve water way section having an inlet in communication with the transversely extending outlet passageway of the first valve water way portion of the first valve assembly, and an outlet; a second valve water way section having an inlet in communication with the transversely extending outlet passageway of the second valve water way portion of the second valve assembly, and an outlet; and a spout receiving section comprising the spout receiving portion of the bridge, and having a first inlet and a second inlet, wherein the bridge passageway extends through the first valve water way section, the second valve water way section and the spout receiving section of the bridge when the first valve water way section, the second valve water way section and spout receiving section are assembled, the outlet of the first valve water way section is configured to engage the first inlet of the spout receiving section and the outlet of the second valve water way section is configured to engage the second inlet of the spout receiving section.

35. The faucet assembly of claim 34, wherein the spout receiving section of the bridge comprises at least one tap for receiving a fastener and the cover plate comprises a receiving bore for receiving the fastener so as to connect the spout receiving section of the bridge to the cover plate.

36. The faucet assembly of claim 35, wherein the fastener is a self-tapping screw.

37. A valve assembly for use in an internal water way assembly comprising a shank defining a longitudinally extending interior passageway therein, a valve water way portion positioned on an upper portion of the shank and configured to define a valve seat therein, wherein the valve water way portion has a transversely extending outlet passageway therein configured to mate with a separate bridge of an internal water way assembly, the valve seat configured to receive fluid from a fluid source and to seat a valve cartridge therein, and at least one tap extending outwardly from the valve water way portion and having a hole therein for receiving a fastener such that the valve assembly when assembled as a component in an internal water way is configured to attach the internal water way to a faucet cover plate, wherein the cover plate comprises a top cover plate configured to cover the internal water way assembly and to be positioned on an upper surface portion of the spout tube, and a bottom cover plate, distinct from a putty plate of the valve assembly, configured to cover a bottom surface portion of the spout tube, wherein the top and the bottom cover plates are configured to be locked together, the valve assembly being configured to be attached to a bridge and a spout tube to form an internal water way for a faucet.

38. The valve assembly of claim 37, further comprising a valve cartridge for controlling flow through the internal water way assembly having an inlet for receiving water entering the valve seat and an outlet in communication with the outlet passageway of the valve water way portion.

39. A method of assembling a faucet having an internal water way, comprising:

(a) providing a cover plate having an interior surface defining an interior space;

(b) assembling an internal water way having at least one component comprising a polymeric material by (i) forming a valve assembly comprising a shank defining a longitudinally extending interior passageway therein, and a valve water way portion positioned on an upper portion of the shank and configured to define a valve seat therein, the valve water way portion having a transversely extending outlet passageway therein, and the valve seat being configured to receive fluid from a fluid source, (ii) positioning a valve cartridge in the valve seat, the valve cartridge for controlling flow and having an inlet for receiving water entering the valve seat and an outlet in communication with the outlet passageway of the valve water way portion;

(iii) providing a bridge having a passageway therethrough and a spout receiving portion having a passageway therethrough;

(iv) rotatably positioning the bridge in an angular orientation with respect to the valve assembly that is selected such that a spout tube received in the spout receiving portion, the spout tube, the bridge, and the valve assembly fit within the interior space of the cover plate upon assembly, wherein the bridge is configured to be fully assembled to the faucet in any one of a plurality of fixed angular orientations with respect to the valve assembly to position the spout tube to fit within the interior space defined by the interior surface of the cover plate and for a variety of cover plates, and;

(v) attaching the bridge to the valve water way portion so that the passageway within the bridge is in fluid communication with and able to receive water from the outlet passageway of the valve water way portion of the valve assembly; and (vi) attaching an inlet end of a spout tube to the spout receiving portion of the bridge to form an assembled internal water way, wherein the spout tube is open at the inlet end so as to be in fluid communication with the passageway in the bridge upon attachment and the spout tube has a second outlet end for delivering water out of the faucet assembly when in use;

(c) positioning the cover plate over the assembled internal water way and attaching the interior surface of the cover plate to the assembled internal water way; and (d) positioning a faucet handle on the valve cartridge so that the handle is capable of operably moving the valve cartridge for controlling the flow through the assembled internal water way, wherein the cover plate comprises a top cover plate configured to cover the internal water way assembly and to be positioned on an upper surface portion of the spout tube, and a bottom cover plate, distinct from a putty plate of the faucet, configured to cover a bottom surface portion of the spout tube, wherein the top and the bottom cover plates are configured to be locked together.

40. The method of assembling a faucet having an internal water way of claim 39, wherein step (b)(i) further comprises forming a second valve assembly comprising a second shank defining a longitudinally extending interior passageway therein, and a second valve water way portion positioned on an upper portion of the second shank and configured to define a second valve seat therein, the second valve water way portion having a transversely extending outlet passageway therein, and the second valve seat being configured to receive fluid from a fluid source;

step (b)(ii) further comprises positioning a second valve cartridge in the second valve seat, the second valve cartridge for controlling flow and having an inlet for receiving water entering the second valve seat and an outlet in communication with the outlet passageway of the second valve water way portion;

step (b)(v) further comprising attaching the bridge to the second valve water way portion so that the passageway within the bridge is in fluid communication with and able to receive water from the outlet passageway of the second valve water way portion of the valve assembly; and step (d) further comprises positioning a second faucet handle on the second valve cartridge so that the second handle is capable of operably moving the second valve cartridge for controlling the flow through the assembled internal water way.

41. A faucet assembly, comprising (a) a cover plate having an interior surface and an exterior surface; and (b) an internal water way assembly, comprising (i) a valve assembly having a shank defining a longitudinally extending interior passageway therein, and a valve water way portion positioned on an upper portion of the shank and configured to define a valve seat therein, wherein the valve water way portion has a transversely extending outlet passageway therein, and the valve seat is configured to receive fluid from a fluid source, and (ii) a valve cartridge for controlling flow through the internal water way assembly having an inlet for receiving water entering the valve seat and an outlet in communication with the outlet passageway of the valve water way portion;

(iii) a bridge having a passageway therethrough in fluid communication with and to receive water from the outlet passageway of the valve water way portion of the valve assembly and the bridge having a spout receiving portion having a passageway therethrough; and (iv) a spout tube having an inlet end configured to be positioned in the spout receiving portion of the bridge, the spout tube open at the inlet end and in fluid communication with the passageway in the bridge and having a second outlet end for delivering water out of the faucet assembly when in use; and (c) at least one faucet handle positioned outside an interior space defined by the interior surface of the cover plate and capable of operably moving the valve cartridge for controlling the flow through the internal water way assembly, (d) a putty plate, wherein the internal water way assembly is configured to be directly attached to the cover plate after assembly of the internal water way assembly, the valve assembly has at least one outwardly extending tap with a hole therein for receiving a fastener and the interior surface of the cover plate has at least one receiving bore for receiving the fastener wherein the internal water way assembly attaches to the interior surface of the cover plate by the fastener;

the bridge is a separate component that is configured to be fully assembled to the faucet assembly in any one of a plurality of fixed angular orientations with respect to the valve assembly to position the spout tube to fit within an interior space defined by the interior surface of the cover plate and for a variety of cover plates, the cover plate comprises a top cover plate configured to cover the internal water way assembly and to be positioned on an upper surface portion of the spout tube, and a bottom cover plate configured to cover a bottom surface portion of the spout tube, wherein the top and the bottom cover plates are configured to be locked together, and wherein the bottom cover plate is distinct from the putty plate, and at least one component in the internal water way assembly comprises a polymeric material.

42. The faucet assembly of claim 41, wherein the internal water way assembly is releasably attached to the interior surface of the cover plate by the fastener.

* * * * *